US005092134A

United States Patent [19]

Tagashira et al.

[11] Patent Number: 5,092,134

[45] Date of Patent: Mar. 3, 1992

[54] HEATING AND COOLING AIR CONDITIONING SYSTEM WITH IMPROVED DEFROSTING

[75] Inventors: Hideaki Tagashira; Masami Imanishi; Shunsuke Ohara; Katsumi Kasano; Takeshi Yoshida; Hitoshi Kido; Yoshimichi Nakagawa, all of Wakayama, Japan

[73] Assignee: Mitsubishi Denki Kabushiki Kaisha, Tokyo, Japan

[21] Appl. No.: 567,822

[22] Filed: Aug. 15, 1990

[30] Foreign Application Priority Data

| | | | |
|---|---|---|---|
| Aug. 18, 1989 | [JP] | Japan | 1-213579 |
| Dec. 19, 1989 | [JP] | Japan | 1-329902 |
| May 23, 1990 | [JP] | Japan | 2-133002 |

[51] Int. Cl.[5] ..... F25B 47/02; F25D 21/06

[52] U.S. Cl. ..... 62/155; 62/160; 62/196.4; 62/278; 62/324.5

[58] Field of Search ..... 62/196.4, 81, 277, 278, 62/160, 155, 156, 324.1, 324.5, 324.6, 234, 196.1, 196.3, 197

[56] References Cited

U.S. PATENT DOCUMENTS

| | | | |
|---|---|---|---|
| 3,905,202 | 9/1975 | Taft et al. | 62/196.4 X |
| 4,389,851 | 6/1983 | Chrostowski et al. | 62/278 X |
| 4,799,363 | 1/1989 | Nakamura | 62/324.1 X |
| 4,831,835 | 5/1989 | Beehler et al. | 62/196.1 |

FOREIGN PATENT DOCUMENTS 1-291077 11/1989 Japan .

OTHER PUBLICATIONS

Heat Pump-Practical design and Application by Jatec Press, pp. 120-123, D. A. Reay et al., Jul. 5, 1958.

*Primary Examiner*—Harry B. Tanner

*Attorney, Agent, or Firm*—Oblon, Spivak, McClelland, Maier & Neustadt

[57] ABSTRACT

An air conditioning system including a refrigerant circuit having a compressor, a three port switching valve, a four port reversing valve, an outdoor heat exchanger, a first throttle device including a first decompression device, a second throttle device including a first decompression device, an indoor heat exchanger and an accumulator connected in series by use of refrigerant pipes; a first bypass circuit which is constructed to carry out heat exchange with the intake pipe connecting between the accumulator and the compressor, and which is connected as a bypass to the pipe connecting between the first and second throttle devices; a second bypass circuit having a check valve to bypass the first decompression device; a third bypass circuit having a check valve to bypass the second decompression device; a fourth bypass circuit which is connected as a bypass to the pipe between the first and second throttle devices, and which is smaller than the discharge pipe in inside diameter; and a fifth bypass circuit which is connected as a bypass to the pipe between the first and second throttle devices through a pressure regulating valve; wherein the three port switching valve is switched to open the fourth bypass circuit, thereby carrying out defrosting.

3 Claims, 10 Drawing Sheets

HEATING AND COOLING AIR CONDITIONING SYSTEM WITH IMPROVED DEFROSTING

BACKGROUND OF THE INVENTION

1. Field of the Invention

The present invention relates to improved air conditioning systems which utilize at least one refrigeration cycle circuit to carry out room cooling and room heating operation.

2. Discussion of Background

Such type of air conditioning systems have been constructed as shown in "HEAT PUMP—Practical Design and Application—" (page 122 FIG. 4. 12). An example of the conventional air conditioning systems will be described briefly with reference to FIG. 9. In FIG. 9, reference numeral 1 designates a compressor. Reference numeral 2 designates a four port reversing valve. Reference numeral 3 designates an outdoor heat exchanger. Reference numerals 4 and 5 designate a first throttle device and a second throttle device, respectively, which function as expansion devices on room heating and on room cooling, respectively. Reference numeral 6 designates an indoor heat exchanger. Reference numeral 7 designates an accumulator. These members are connected in series by refrigerant pipes to form a refrigeration cycle circuit. Reference numerals 8 and 9 designate an indoor fan and an outdoor fan, respectively, which feed air to the indoor heat exchanger 6 and the outdoor heat exchanger 3, respectively. Reference numerals **4*a* and 4*b* designate a first decompression device (capillary tube) and a first check valve, respectively, the first check valve being arranged in a circuit for bypassing the first decompression device. The first decompression device and the first check valve constitute the first throttle device 4. Reference numerals 5*a* and 5*b* designate a second decompression device (capillary tube) and a second check valve, respectively, the second check valve is arranged in a circuit for bypassing the second decompression device. The second decompression device and the second check valve constitute the second throttle device 5**.

The operation of the air conditioning system as constructed above will be described.

On room cooling (the flow of a refrigerant is indicated by arrows of thick solid lines in FIG. 9), the refrigerant that has been discharged from the compressor 1 and has become a gas having high temperature under high pressure passes through the four port reversing valve 2. In the outdoor heat exchanger 3, the gaseous refrigerant carries out heat exchange with the outside air which is fed by the outdoor fan 9, thereby being condensed and liquefied. The refrigerant thus liquefied passes through the first check valve **4*b* in the bypass circuit of the first throttle device 4, and is taken into the second decompression device 5*a* forming a part of the second throttle device 5, thereby being decompressed and becoming a liquid refrigerant having low temperature under low pressure. After that, the liquid refrigerant enters the indoor heat exchanger 6, carries out heat exchange with the indoor air which is fed by the indoor fan 8. As a result, the liquid refrigerant cools the indoor air to be evaporated. The refrigerant thus evaporated returns to the compressor 1 through the four port reversing valve 2 and the accumulator 7**. The refrigeration cycle on cooling is formed in this manner. The refrigerant is circulated in the refrigeration cycle circuit, repeating the foregoing liquefaction and evaporation in that order.

On heating (the flow of the refrigerant is indicated by arrows of thin solid lines in FIG. 9), the refrigerant which has been discharged from the compressor 1 and has become a gas having high temperature under high pressure passes through the four port reversing valve 2 which has been switched to heating mode. The gaseous refrigerant enters the indoor heat exchanger 6, and carries out heat exchange with the indoor air which is fed by the indoor fan 8. As a result, the refrigerant heats the indoor air to be condensed and liquefied. After that, the refrigerant thus liquefied passes through the second check valve **5*b* which is arranged in the circuit for bypassing the second throttle device 5. The refrigerant is directed to the first decompression device 4*a* forming a part of the first throttle device 4. In the first decompression device, the refrigerant is depressurized to become a liquid refrigerant having low temperature under low pressure. After that, the refrigerant thus liquefied enters the outdoor heat exchanger 3, and carries out heat exchange with the outdoor air which is fed by the outdoor fan 9. As a result, the refrigerant absorbs heat from the outdoor air to cool it and to be evaporated. The refrigerant thus evaporated returns to the compressor 1 through the four port reversing valve 2 and the accumulator 7**. The refrigeration cycle on heating is formed in this manner.

When such heating operation is continued, frost can be produced on the outdoor heat exchanger 3 in e.g. the case wherein the temperature of the outdoor air is low. When the frost has deposited on the outdoor heat exchanger in large amounts, heat exchange efficiency deteriorates. As a result, the heat absorption amount from the outdoor air decreases to significantly lower the heating capacity of the system. For this reason, defrosting is required in such case. The defrosting operation has been made as described in the article "HEAT PUMP—Practical Design and Application—" (page 121).

Referring to FIG. 9, on the defrosting operation (the flow of the refrigerant is indicated by arrows by dotted lines in FIG. 9), the refrigerant which has been discharged from the compressor 1 and has become a gas having high temperature under high pressure passes through the four port reversing valve 2 which has been switched from heating mode to cooling mode. Then, the refrigerant enters the outdoor heat exchanger 3 with the outdoor fan 9 stopped. The frost which has deposited on the outer surface of the outdoor heat exchanger 3 is melted by the gaseous refrigerant having high temperature. As a result, the refrigerant is condensed and liquefied. The refrigerant thus liquefied passes through the first check valve **4*b* forming a part of the first throttle device 4. The refrigerant is depressurized by the second decompression device 5*a* forming a part of the second throttle device 5, thereby being a gas having low temperature under low pressure. Then, the refrigerant thus liquefied enters the indoor heat exchanger 6. The refrigerant returns to the compressor 1 through the four port reversing valve 2 and the accumulator 7**. The refrigeration cycle on the defrosting operation is formed in this way.

FIG. 10 is a schematic diagram showing the refrigerant circuit of another conventional air conditioning system wherein a first refrigeration cycle circuit and a second refrigeration cycle circuit are independently provided, and the indoor heat exchangers arranged in the respective refrigeration cycle circuits are fed air by a common fan. In FIG. 10, reference numeral 1a0 designates a compressor. Reference numeral 2a designates a four port reversing valve which can switch operation modes in the first refrigeration cycle circuit. Reference numeral 3a designates an outdoor heat exchanger. Reference numerals 4a and 5a designate a first throttle device and a second throttle device, respectively, which function as expansion devices on heating and on cooling, respectively. Reference numeral 6a designates an indoor heat exchanger. Reference numeral 7a designates an accumulator. These members are connected in series by refrigerant pipes to form the first refrigeration cycle circuit. Reference numeral 9a designates an outdoor fan which feeds air to the outdoor heat exchanger 3a. Reference numerals 4aa and 4ab designate a first decompression device (e.g. a capillary tube) and a first check valve, respectively, the first check valve being arranged in a circuit for bypassing the first decompression device. The first decompression device and the first check valve constitute the first throttle device 4a. Reference numerals 5aa and 5ab designate a second decompression device (e.g. a capillary tube) and a second check valve, respectively, the second check valve being arranged in a circuit for bypassing the second decompression device. The second decompression device and the second check valve constitute the second throttle device 5a.

Reference numeral 1b0 designates a compressor. Reference numeral 2b designates a four port reversing valve which can switch operating modes in the second refrigeration cycle circuit. Reference numeral 3b designates an outdoor heat exchanger. Reference numerals 4b and 5b designate a first throttle device and a second throttle device, respectively, which function as expansion devices on heating and on cooling, respectively. Reference numeral 6b designates an indoor heat exchanger. Reference numeral 7b designates an accumulator. These members are connected in series to form the second refrigeration cycle circuit 11.

Reference numeral 9b designates an outdoor fan which feeds air to the outdoor heat exchanger 3b. Reference numerals 4ba and 4bb designate a first decompression device (e.g. a capillary tube) and a first check valve, respectively, the first check valve being arranged in a circuit for bypassing the first decompression device. The first decompression device and the first check valve constitute the first throttle device 4b. Reference numerals 5ba and 5bb designate a second decompression device (e.g. a capillary tube) and a second check valve, respectively, the second check valve being arranged in a circuit for bypassing the second decompression device. The second decompression device and the second check valve constitute the second throttle device 5b.

Reference numeral 8 designates a common fan which feeds air to the indoor heat exchanger 6a in the first refrigeration cycle circuit 10 and to the indoor heat exchanger 6b in the second refrigeration cycle circuit 11.

The operation of the air conditioning system having such structure will be described.

Firstly, the operation of the first refrigeration cycle circuit 10 will be explained. In the first refrigeration cycle circuit 10, on cooling (the flow of the refrigerant is indicated by arrows of thick solid line in FIG. 10), the refrigerant which has been discharged from the compressor 1a0 and has become a gas having high temperature under high pressure passes through the four port reversing valve 2a. In the outdoor heat exchanger 3a, the gaseous refrigerant carries out heat exchange with the outdoor air which is fed by the outdoor fan 9a, thereby being condensed and liquefied. The refrigerant thus liquefied passes through the check valve 4ab in the bypass circuit at the first throttle device 4a, and is directed to the second decompression device 5aa constituting the second throttle device 5a. The refrigerant is depressurized there to become a liquid having low temperature under low pressure. After that, the refrigerant thus liquefied enters the indoor exchanger 6a, and carries out heat exchange with the indoor air which is fed by the indoor fan 8. As a result, the liquid refrigerant cools the indoor air to be evaporated. The refrigerant thus evaporated returns to the compressor 1a0 through the four port reversing valve 2a and the accumulator 7a. The refrigeration cycle on cooling is formed in this manner. The refrigerant circulates in the refrigeration cycle circuit, repeating the foregoing liquefaction and evaporation in that order.

Secondly, on heating (the flow of the refrigerant is indicated by arrows of thin solid line in FIG. 10), the refrigerant which has been discharged from the compressor 1a0 and has become a gas having high temperature under high pressure passes through the four port reversing valve 2a which has been switched to heating mode. The gaseous refrigerant enters the indoor heat exchanger 6a, and carries out heat exchange with the indoor air which is fed by the indoor fan 8. As a result, the gaseous refrigerant heats the indoor air to be condensed and liquefied. The refrigerant thus liquefied passes through the second check valve 5ab in the second throttle device 5a, and is directed to the first decompression device 4aa constituting the first throttle device 4a. The liquid refrigerant is depressurized there to become a liquid having low temperature under low pressure. After that, the liquid refrigerant enters the outdoor heat exchanger 3a, and carries out heat exchange with the outdoor air which is fed by the outdoor fan 9a. The liquid refrigerant absorbs heat from the outdoor air to cool the outdoor air and to be evaporated. The refrigerant thus evaporated returns to the compressor 1a0 through the four port reversing valve 2a and the accumulator 7a. The refrigeration cycle on heating is formed in this way.

When such heating operation is continued, frost can deposit on the outdoor heat exchanger 3a in e.g. the case wherein the temperature of the outdoor air is low. When frost has deposited on the outdoor heat exchanger 3a in large amounts, heat exchange efficiency deteriorates. As a result, the heat absorption amount from the outdoor air decreases to significantly lower the heating capability of the system. For this reason, defrosting is required in such case.

On such defrosting operation (the flow of the refrigerant is indicated by arrows of dotted line in FIG. 10), the refrigerant which has been discharged from the compressor 1a0 and has become a gas having high temperature under high pressure passes through the four port reversing valve 2a which has been switched from the heating mode to cooling mode. Then, the gaseous refrigerant enters the outdoor heat exchanger 3a with the outdoor fan 9a stopped. The frost which has deposited on the outer surface of the outdoor heat exchanger 3a is melted by the gaseous refrigerant having high temperature. It causes the refrigerant to be condensed and liquefied. The refrigerant thus liquefied passes through the first check valve 4ab in the first throttle device 4a, and is depressurized by the second decompression device 5aa constituting the second throttle device 5a, thereby becoming a liquid having low temperature under low pressure. Then, the liquid refrigerant enters the indoor heat exchanger 6a, and returns to the compressor 1a0 through the four port reversing valve 2a and the accumulator 7a. The refrigeration cycle on the defrosting operation is carried out in this manner. Explanation on the cooling operation, the heating operating and the defrosting operation of the second refrigeration cycle circuit 11 will be omitted because those of the second refrigeration cycle circuit 11 are made like those of the first refrigeration cycle circuit 10.

In the conventional system as shown in FIG. 9, the introduction of the liquid refrigerant having low temperature under low pressure to the indoor heat exchanger 6 on defrosting under the heating operation creates some problems. Specifically, the indoor fan 8 which is arranged to face toward the indoor heat exchanger 6 carries out a breeze operation wherein a gentle wind is fed, or is stopped on the defrosting operation. When the breeze operation is carried out, the liquid refrigerant having low temperature under low pressure carries out heat exchange with the indoor air to cool it, and to be evaporated. The refrigerant thus evaporated returns to the compressor 1 through the four port reversing valve 2 and the accumulator 7. In this case, cool air is blown off indoors, thereby providing a disadvantage in that room heating effect significantly deteriorates.

When the indoor fan 8 is stopped, the liquid refrigerant having low temperature under low pressure can not absorb heats from the indoor air. The refrigerant enters the accumulator 7 and returns to the compressor 1 in the form of a liquid. As a result, the compressor 1 has to compress the liquid, causing trouble in the compressor.

In addition, in the conventional system shown in FIG. 9, the pressure at the high pressure side is low, particularly on defrosting, and the pressure at the lower pressure side therefore lowers, providing disadvantages in that the compressor 1 is prevented from achieving the best performance, and that the defrosting time is long. Further, on heating, the four port reversing valve 2 is switched to the cooling mode to carry out the defrosting operation, creating the problem wherein heat loss is caused at the time of switching.

On the other hand, in the conventional air conditioning system as shown in FIG. 10, the indoor heat exchangers 6a and 6b in the first and second refrigeration cycle circuits 10 and 11 which are independent of each other are fed air by the common fan 8. This arrangement can not stop the fan 8 because when either (e.g. the first refrigeration cycle circuit 10) of the first and second refrigeration cycle circuits 10 and 11 carries out the defrosting operation on heating to introduce the liquid refrigerant having low temperature under low pressure into the indoor heat exchanger 6a in the first refrigeration cycle circuit 10, the other refrigeration cycle circuit or the second refrigeration cycle circuit 11 is under the heating operation. As a result, in the indoor heat exchanger 6a of the first refrigeration cycle circuit 10, the liquid refrigerant having low temperature under low pressure carries out heat exchange with the indoor air to blow out the cooled air into the room with the indoor heat exchanger in it, thereby significantly deteriorating the room heating effect. In addition, the pressure at the high pressure side is low on the defrosting operation, and the pressure at the low pressure side therefore lowers, thereby preventing the compressor laO from achieving the best performance and causing the defrosting time to be lengthened. Further, on heating, the four port reversing valve 2a is switched to the cooling mode to carry out the defrosting operation, thereby providing a disadvantage in that heat loss is caused at the time of switching.

SUMMARY OF THE INVENTION

It is an object of the present invention to dissolve the problems of the conventional air conditioning systems, and to provide a new and improved air conditioning system capable of preventing cooled air from blowing off into a room on defrosting under the heating operation, of preventing heat loss from being caused at the time of switching to the defrosting operation, and of completing the defrosting operation for a short time.

It is another object of the present invention to provide a new and improved air conditioning system capable of completing the defrosting operation for a short time without blowing off the cooled air into the room, causing the heat loss, and raising the pressure at the high pressure side at high degress.

According to a first aspect of the present invention, there is provided an air conditioning system which can carry out cooling and heating; comprising: a refrigerant circuit which is constituted by connecting a compressor, a three port switching valve, a four port reversing valve, an outdoor heat exchanger, a first throttle device including a first decompression device, a second throttle device including a first decompression device, an indoor heat exchanger and an accumulator in series by use of refrigerant pipes; a first bypass circuit which diverges from the pipe connecting between the three port switching valve and the four port reversing valve, which is constructed to carry out heat exchange with the intake pipe connecting between the accumulator and the compressor, and which is connected as a bypass to the pipe connecting between the first and second throttle devices; a second bypass circuit having a check valve to bypass the first decompression device; a third bypass circuit having a check valve to bypass the second decompression device; a fourth bypass circuit which diverges from the discharge pipe through the three port switching valve, which is connected as a bypass to the pipe between the first and second throttle devices, and which is smaller than the discharge pipe in inside diameter; and a fifth bypass circuit which diverges from the pipe connecting between the discharge pipe and the three port switching valve, and which is connected as a bypass to the the pipe between the first and second throttle devices through a pressure regulating valve; wherein the three port switching valve is switched to open the fourth bypass circuit, thereby carrying out defrosting.

Preferably, the air conditioning system is operated so that when the temperature in the room to be air conditioned is not higher than a predetermined level during the defrosting operation, the three port switching valve is returned to heating mode at a predetermined time interval.

In addition, preferably, the air conditioner system is so constructed that it further comprises an eighth bypass circuit which diverges from the pipe connecting between the indoor heat exchanger and the second throttle valve, and which is connected as a bypass to the accummulator through an on-off valve; wherein when the temperature in the room to be air conditioned is not higher than a predetermined level during the defrosting operation, the eighth bypass circuit is opened at a predetermined time interval.

According to a second aspect of the present invention, there is provided an air conditioning system which can carry out cooling and heating: comprising: a first refrigeration cycle circuit and a second refrigeration cycle circuit which are independently constituted by connecting compressors, four port reversing valves, outdoor heat exchangers, first throttle devices including first decompression devices, second throttle device including second decompression devices, and indoor heat exchangers in series by use of refrigerant pipes, respectively; a fan which is in common used to provide air to the indoor heat exchangers in the first and second refrigeration cycle circuits; second bypass circuits which are arranged in the first and second refrigeration cycle circuits, respectively, and which have check valves to bypass the first decompression devices, allowing a refrigerant to flow in the direction toward the outdoor heat exchangers; third bypass circuits which are arranged in the first and second refrigeration cycle circuits, respectively, and which have check valves to bypass the second decompression devices; fourth bypass circuits which are arranged in the first and second refrigeration cycle circuits, respectively, which diverge from the discharge pipes through three port switching valves, which are connected as bypasses to the pipes connecting between the first and second throttle devices, and which are smaller than the discharge pipes in inside diameter; a sixth bypass circuit through which part of the refrigerant discharged from the compressor in the first refrigeration cycle circuit bypassed to the intake port of the compressor in the first refrigeration cycle circuit through an on-off valve, and which can carry out heat exchange on the way with the intake pipe of the compressor in the second refrigeration cycle circuit; and a seventh bypass circuit through which part of the refrigerant discharged from the compressor in the second refrigeration cycle circuit is bypassed to the intake port of the compressor in the second refrigeration cycle circuit through an on-off valve, and which can carry out heat exchange on the way with the intake pipe of the compressor in the first refrigeration cycle circuit; wherein the three port switching valve in one of the first refrigeration cycle circuit and the second refrigeration cycle circuit is switched to make connection to the fourth bypass circuit, and the on-off valve in the other refrigeration cycle circuit is opened, carrying out defrosting.

Preferably, the air conditioning system is so constructed that it further comprises pressure regulating valves which are arranged in the first and second refrigeration cycle circuits to be in parallel with the fourth bypass circuits, respectively, and which are opened depending on the pressures at the pressure sides of the compressors.

According to the third aspect of the present invention, there is provided an air conditioning system which can carry out cooling and heating; comprising: a first refrigeration cycle circuit and a second refrigeration cycle circuit which are independently constituted by connecting compressors, four port reversing valves, outdoor heat exchangers, first throttle devices including first decompression devices, second throttle devices including second decompression devices, and indoor heat exchangers in series by use of refrigerant pipes, respectively; a fan which is in common used to provide air to the indoor heat exchangers in the first and second refrigeration cycle circuits; second bypass circuits which are arranged in the first and second refrigeration cycle circuits, respectively, and which have check valves to bypass the first decompression devices, allowing a refrigerant to flow in the direction toward the outdoor heat exchangers; third bypass circuits which are arranged in the first and second refrigeration cycle circuits, respectively, and which have check valves to bypass the second decompression devices; fourth bypass circuits which are arranged in the first and second refrigeration cycle circuits, respectively, which diverge from the discharge pipes through three port switching valves, which are connected as bypasses to the pipes connecting between the first and second throttle devices, and which are smaller than the discharge pipes in inside diameter; a sixth bypass circuit through which part of the refrigerant discharged from the compressor in the first refrigeration cycle circuit is bypassed to the pipe connecting between the first and second throttle devices in the first refrigeration cycle circuit through a decompression device and on-off valve for bypassing the decompression device, and which can carry out heat exchange on the way with the intake pipe of the compressor in the second refrigeration cycle circuit; and a seventh bypass circuit through which part of the refrigerant discharged from the compressor in the second refrigeration cycle circuit is bypassed to the pipe connecting between the first and second throttle devices in the second refrigeration cycle circuit through a decompression device and an on-off valve for bypassing the decompression device, and which can carry out heat exchange on the way with the intake pipe of the compressor in the first refrigeration cycle circuit; wherein the three port switching valve in one of the first refrigeration cycle circuit and the second refrigeration cycle circuit is switched to make connection to the fourth bypass circuit, and the on-off valve in the other refrigeration cycle circuit is opened, carrying out defrosting.

Preferably, the air conditioning system is so constructed that it further comprises pressure regulating valves which are arranged in the first and second refrigeration cycle circuits to be in parallel with the fourth bypass circuits, respectively, and which are opened depending on the pressures at the high pressure sides of the compressors.

In addition, preferably, the air conditioning system is so constructed that it further comprises fifth bypass circuits which are arranged in the first and second refrigeration cycle circuits, respectively, which diverge from the pipe connecting between the compressors and three port switching valves, and which are connected to the pipes connecting the between the first and second throttle devices through pressure regulating valves.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
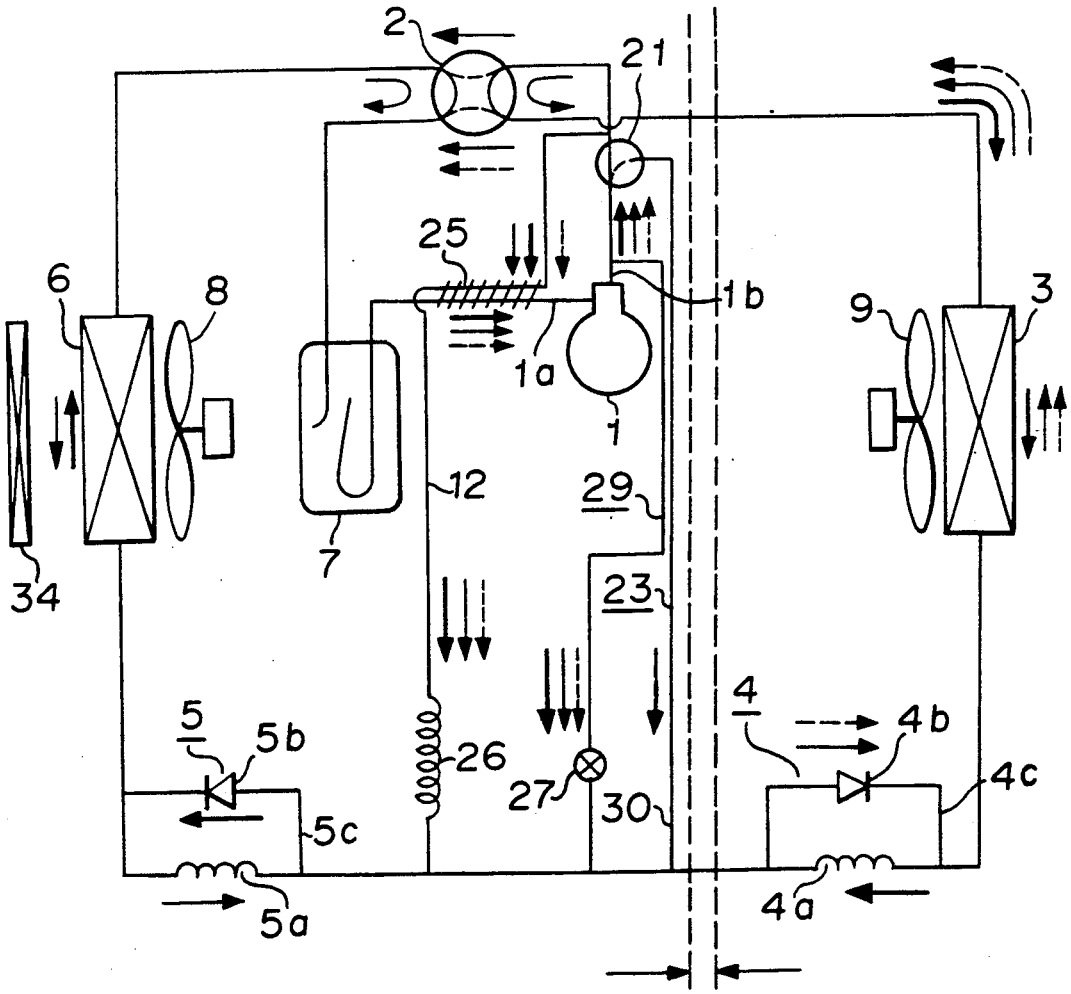
FIG. 1 is a schematic diagram showing the refrigerant circuit of a first embodiment of the air conditioning system according to the present invention.
Figure 9:
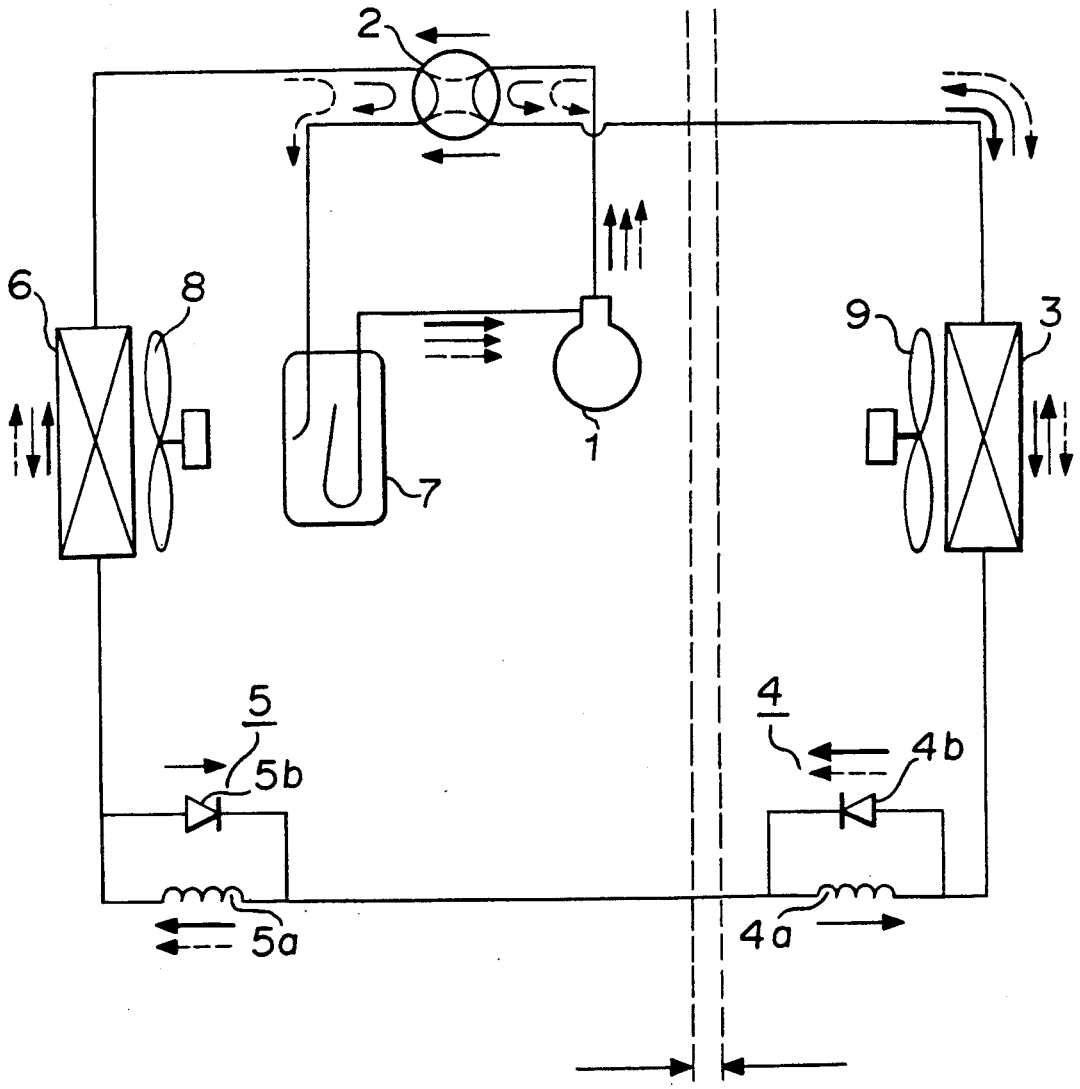
FIGURE 9 PRIOR ART
FIGS. 9 and 10 are schematic diagrams showing a refrigerant circuit of the conventional air conditioning systems.
Figure 10:
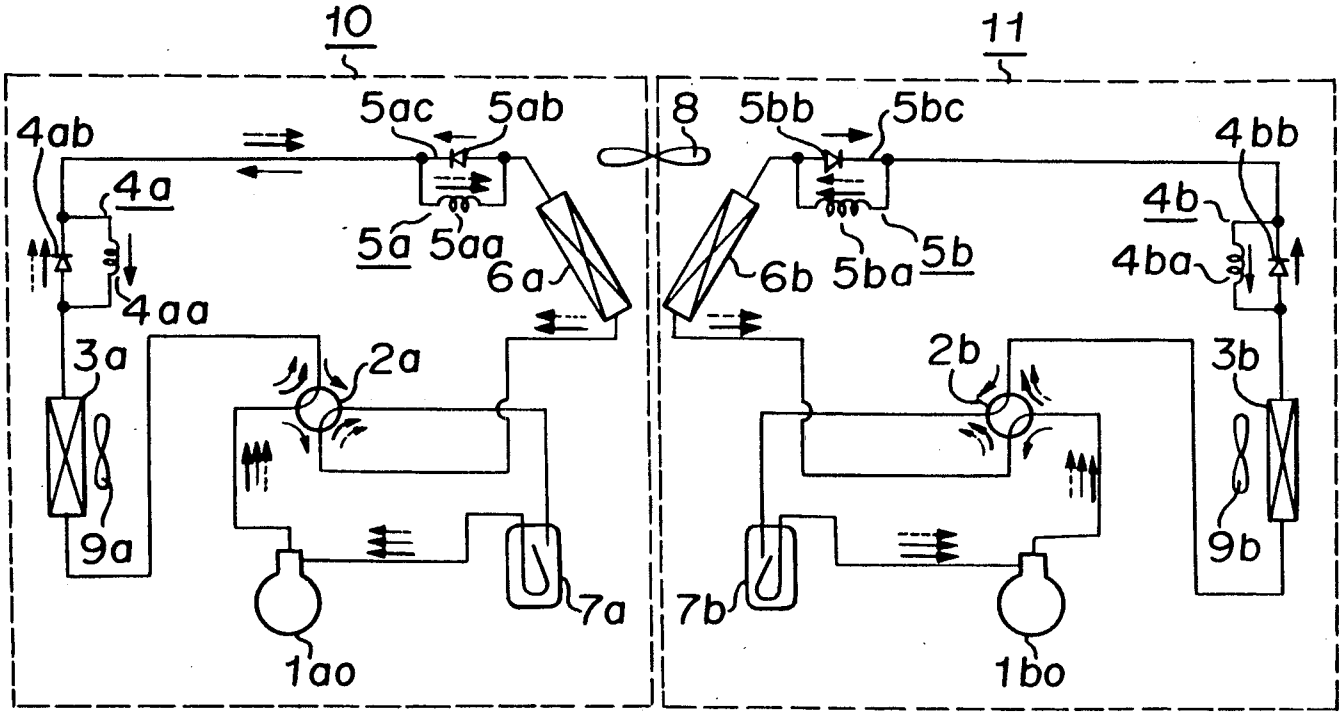
FIGURE 10 PRIOR ART

Referring now to the drawings, wherein like reference numerals designate identical or corresponding parts throughout the several views, and more particularly to FIG. 1 thereof, there is shown a first embodiment of the air conditioning system according to the present invention. In FIG. 1, parts which are identical or corresponding to those of the conventional air conditioning system shown in FIG. 9 are indicated by the same reference numerals as those of the conventional air conditioning system, and explanation on these parts will be omitted for the sake of clarity.

As shown in FIG. 1, the air conditioning system of the first embodiment according to the present invention includes a refrigerant circuit which is constituted by connecting a compressor 1, a three port switching valve 21, a four port reversing valve 2, an outdoor heat exchanger 3, a first throttle device 4 having a decompression device 4*a* in it, a second throttle device 5 having a second decompression device 5*a* in it, an indoor heat exchanger 6 and an accumulator 7 in series by means of refrigerant pipes. The air conditioning system also includes a first bypass pipe 12 which diverges from the pipe connecting between the three port switching valve 21 and the four port reversing valve 2, which passes through a suction heat exchanger 25 that is constituted to enable the first bypass pipe 12 to carry out heat exchange with an intake pipe 1*a* connecting between the accumulator 7 and the compressor 1, and which has an auxiliary capillary tube 26, and is connected to the pipe connecting between the first throttle device 4 and the second throttle device 5 as a bypass. In addition, the air conditioning system includes a second bypass circuit 4*c* where a first check valve 4*b* is arranged to bypass the first decompression device 4*a*, and a third bypass circuit 5*c* where a second check valve 5*b* is arranged to bypass the second decompression device 5*a*. Further, the air conditioning system includes a fourth bypass circuit 23 which extends from a discharge pipe 1*b* of the compressor 1 to the pipe between the first throttle device 4 and the second throttle device 5 through the three port switching valve 21 as a bypass, and which is constituted by a pipe 30 having a smaller inside diameter than the discharge pipe 1*b*, and a fifth bypass circuit 29 which extends through a pressure regulating valve 27 from the pipe between the discharge pipe 1*b* and the three port switching valve 21 to the pipe between the first throttle device 4 and the second throttle device 5 as a bypass.

In the air conditioning device having such structure, while the four port reversing valve 2 is set under heating mode, fans 8 and 9 which feed air to the indoor heat exchanger 6 and the outdoor heat exchanger 3 are stopped, and the three port switching valve 21 is switched to open the fourth bypass circuit 23 in order to carry out defrosting operation.

In the air conditioning device having such structure, on cooling (the flow of a refrigerant is indicated by arrows of thick solid line in FIG. 1), the refrigerant which has been discharged from the compressor 1 and has become a gas having high temperature and high pressure passes through the four port reversing valve 2. In the outdoor heat exchanger 3, the gaseous refrigerant carries out heat exchange with the outdoor air which is fed by the outdoor fan 9, thereby being condensed and liquefied. The refrigerant thus liquefied is depressurized by the first decompression device 4*a* in the first throttle device 4 to become a liquid having low temperature and low pressure. On the other hand, part of the gaseous refrigerant which has been discharged from the compressor 1 is introduced into the first bypass circuit 12. In the suction heat exchanger 25, that part of the gaseous refrigerant carries out heat exchange with the refrigerant which is about to be inspired into the compressor 1 and has low pressure. As the result of the heat exchange, that part of the gaseous refrigerant heats the inspired refrigerant to completely evaporate it, and that part of the gaseous refrigerant itself is condensed and liquefied. The refrigerant thus liquefied is depressurized by the auxiliary capillary tube 26 to become a liquid having low temperature and low pressure. Then, the liquid refrigerant joins in the pipe between the first throttle device 4 and the second throttle device 5, passes through the third bypass circuit 5*c* in the second throttle device 5, and enters the indoor heat exchanger 6. The liquid refrigerant carries out heat exchange there with the indoor air fed by the indoor fan 8 to cool the indoor air, thereby being evaporated. The refrigerant that thus evaporated returns to the compressor 1 through the four port reversing valve 2 and the accumulator 7. The refrigeration cycle circuit on cooling is formed in that manner.

On heating (the flow of the refrigerant is indicated by arrows of thin solid line in FIG. 1), the refrigerant which has been discharged from the compressor 1 and has become high temperature and high pressure enters the indoor heat exchanger 6 through the four port reversing valve 2 which has been switched to the heating mode. In the indoor heat exchanger 6, the gaseous refrigerant carries out heat exchange with the indoor air fed by the indoor fan 8 to heat the indoor air, thereby being condensed and liquefied. The refrigerant thus liquefied is depressurized by the second decompression device 5*a* in the second throttle device 5 to become a liquid having low temperature and low pressure. Part of the gaseous refrigerant which has been discharged from the compressor 1 is introduced into the first bypass circuit 12. In the suction heat exchanger 25, the part of the gaseous refrigerant carries out heat exchange with the refrigerant which is about to be inspired into the compressor 1 and has low pressure, and heats the inspired refrigerant to complete evaporate it. The gaseous refrigerant itself is condensed and liquefied, and is depressurized by the auxiliary capillary tube 26, thereby becoming a liquid having low temperature and low pressure. The liquid refrigerant joins in the pipe between the first throttle device 4 and the second throttle device 5, passes through the second bypass circuit 4*c* in the first throttle device 4, and enters the outdoor heat exchanger 3. In the outdoor heat exchanger, the liquid refrigerant carries out heat exchange with the outdoor air fed by the outdoor fan 9, and absorbs heat from the outdoor air to cool it, thereby being evaporated. Then, the refrigerant thus evaporated returns the compressor 1 through the four port reversing valve 2 and the accumulator 7. The refrigeration cycle circuit on heating is formed in that manner.

At the time of the defrosting operation (the flow of the refrigerant is indicated by arrows of dotted line in FIG. 1) which is required when frost has deposited on the outdoor heat exchanger 3 due to a decrease in the temperature of the outdoor air under such heating operation, the gaseous refrigerant which has been discharged from the compressor 1 passes through the three port switching valve 21 which has been switched to defrosting mode. The gaseous refrigerant is introduced into the pipe 30 of the fourth bypass circuit 23 which is connected to the pipe between the first throttle device 4 and the second throttle device 5, and enters the pipe between the first and second throttle devices 4 and 5. Then, the gaseous refrigerant enters the outdoor heat exchanger 3 through the second bypass circuit 4*c* in the first throttle device 4. At that time, the outdoor fan 9 is standstill. The gaseous refrigerant having high temperature melts the frost which has deposited on the outer surface of the outdoor heat exchanger 3, thereby being condensed and liquefied. The refrigerant thus liquefied enters the accumulator 7 through the four port reversing valve 2, and returns to the compressor 1.

Such arrangement allows the air conditioning system to shift to the defrosting operation without switching the four port reversing valve 2 from the heating mode to cooling mode, thereby eliminating heat loss due to the switching. In addition, the liquid refrigerant having low temperature can be prevented from passing through the indoor heat exchanger 6, avoiding the problem that cooled air is blown off indoors like the conventional air conditioning systems.

Further, the structure that the pipe 30 forming a part of the fourth bypass circuit 23 is smaller than the discharge pipe 1*b* in inside diameter causes pressure loss to increase the pressure at the high pressure side of the compressor 1, causing input to the compressor 1 to increase. As a result, the capacity of the compressor 1 can be increased to shorten the defrosting time.

A detecting device such as a thermister is arranged to detect the temperature at the outlet of the outdoor heat exchanger 3 during the defrosting operation to make a signal indicative of completion of the defrosting operation. There is a possibility that abnormal stoppage due to high pressure cut causes before the temperature at the outlet of the outdoor heat exchanger 3 has reached a completion temperature. This is because the increased pressure at the high pressure side of the compressor 1 causes the pressure at the high pressure side to abruptly increase just before completion of the defrosting operation. When the pressure at the high pressure side of the compressor 1 abruptly increases, the pressure regulating valve 27 in the fifth bypass circuit 29 opens to maintain the pressure at the high pressure side constant, thereby preventing such abnormal stoppage from causing due to the high pressure cut.

Further, the presence of the suction heat exchanger 25 allows the intake pipe 1*a* of the compressor 1 to carry out heat exchange with the refrigerant which has been discharged from the compressor 1 and has become the gas having high temperature and high pressure. As a result, the liquid can be prevented from returning to the compressor 1 in the form of a liquid, thereby eliminating trouble in the compressor. In addition, although the air conditioning system is operated in the vicinity of completion of the defrosting operation in such almost superheat conditions that the pressures at the high pressure side and the low pressure side of the compressor 1 are raised, the suction heat exchanger 11 is constructed not to work on defrosting, thereby avoiding compressor trouble. By the way, when a heater such as an electric heater is placed to face the indoor heat exchanger 6 as indicated by reference numeral 34 in FIG. 1, the indoor fan 8 can be driven because the refrigerant is not passing through the indoor heat exchanger 6 on defrosting. This arrangement can offer an advantage in that the heating operation can be continued even during the defrosting operation.

When on cooling or heating the pressure at the high pressure side abnormally increases for any reason, the pressure regulating valve 27 in the fifth bypass circuit 29 can open to maintain the pressure at the high pressure side constant, thereby preventing abnormal stoppage from causing due to high pressure cut.

Figure 2:
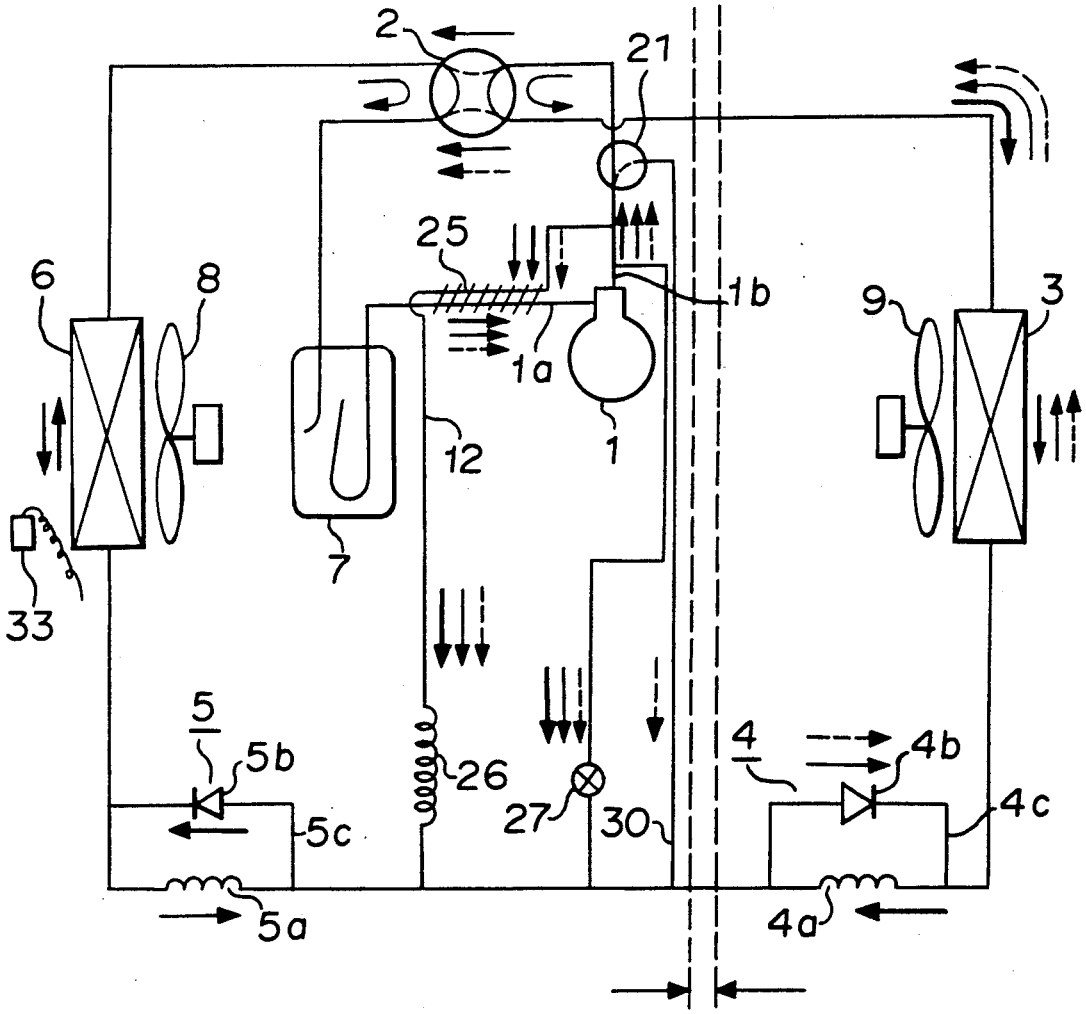
FIGS. 2 and 3 are schematic diagrams showing the refrigerant circuits of other embodiments.

Referring now to FIG. 2, there is shown a second embodiment of the air conditioning system according to the present invention. The second embodiment is different from the first embodiment in that the heater 34 which is arranged to face the indoor heat exchanger 6 is omitted, and that a room temperature detector 33 for detecting the temperature in the room with the indoor heat exchanger installed in it is arranged.

On defrosting, when the room temperature is not higher than a predetermined value (e.g. 5° C.), the pressure in the indoor heat exchanger 6 is approximately 5 $kg/cm^2G$, which means that the pressure in the indoor heat exchanger 6 is lower than the pressure in the pipe between the first and second throttle devices 4 and 5 (normally an intermediate pressure of approximately 10–15 $kg/cm^2G$). This causes the refrigerant to accumulate in the indoor heat exchanger 6 during the defrosting operation. As a result, the amount of the refrigerant which circulates in the refrigerant circuit can be running short. In addition, when the refrigerant has accumulated too much, the indoor heat exchanger 6 can function as a condenser when the defrosting operation is returned to the heating operation. As a result, the indoor heat exchanger as the condenser can be full of the refrigerant to causes the high pressure cut.

In accordance with the second embodiment, the room temperature detector 33 detects the room temperature during the defrosting operation. When the room temperature is not higher than the predetermined value (e.g. 5° C.), the defrosting mode is returned to the heating mode after a predetermined time interval (e.g. after the defrosting operation is carried out for 5 minutes, the heating operation is performed for 1 minute, and the defrosting operation is carried out again).

Figure 3:
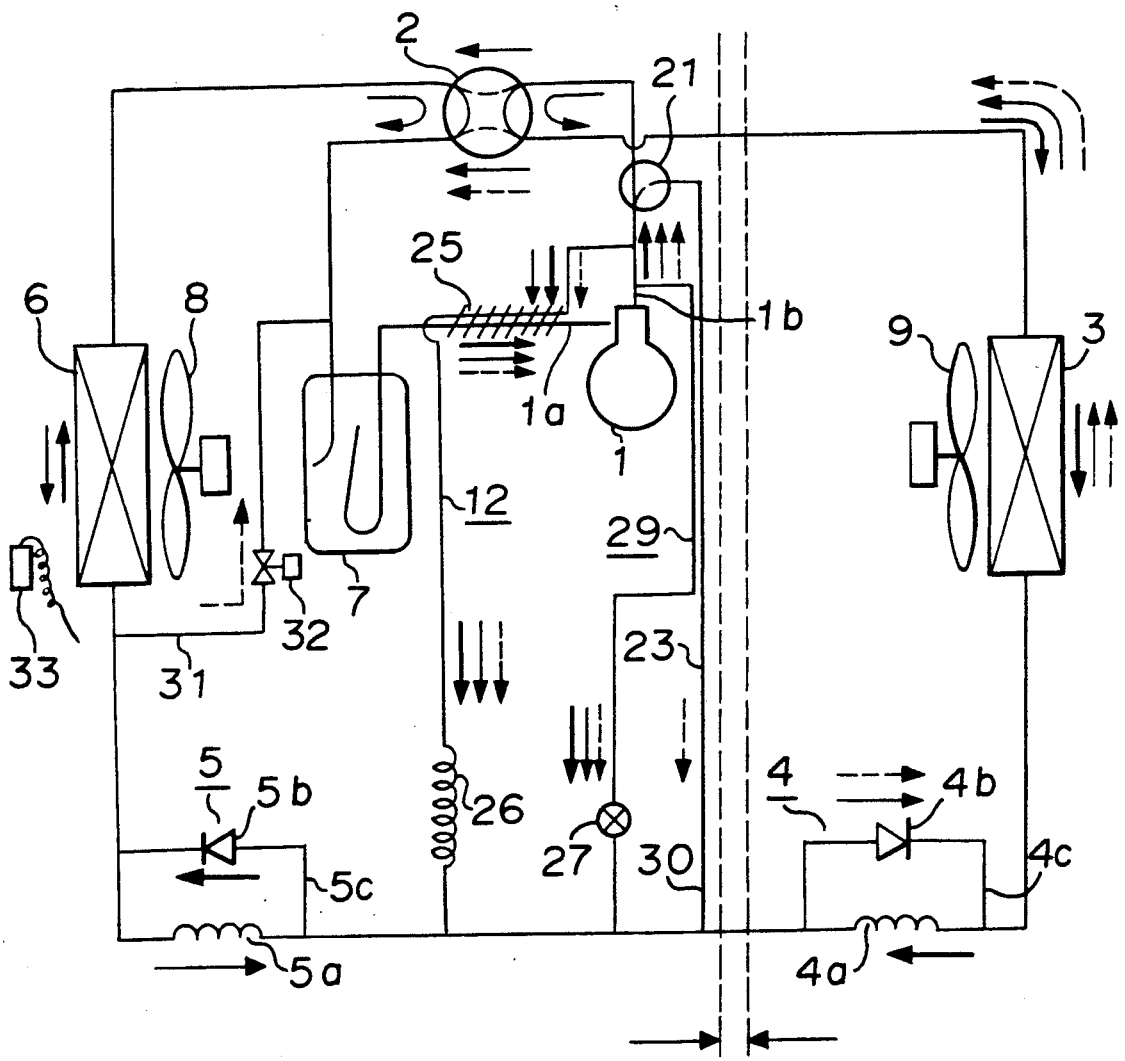

Referring now to FIG. 3, there is shown a third embodiment of the air conditioning system according to the present invention. The third embodiment is different from the second embodiment in that a sixth bypass circuit 31 which has an on-off valve 32 such a solenoid valve in it is arranged to connect the pipe between the indoor heat exchanger 6 and the second throttle device 5 to the pipe between the four port reversing valve 2 and the accumulator 7.

On defrosting, when the room temperature is not higher than a predetermined value (e.g. 5° C.), the pressure in the indoor heat exchanger 6 is approximately 5 $kg/cm^2G$, which means that the pressure in the indoor heat exchanger 6 is lower than the pressure (normally an intermediate pressure of approximately 10–15 $kg/cm^2G$) in the pipe between the first and second throttle devices 4 and 5, causing the refrigerant to accumulate in the indoor heat exchanger 6 during the defrosting operation. As a result, the amount of the refrigerant which circulates the refrigerant circuit is running short. In addition, when the refrigerant has accumulated too much, the indoor heat exchanger 6 functions as a condenser at the time of returning to the heating operation. As a result, the indoor heat exchanger as the condenser can be full of the refrigerant to cause the high pressure cut.

In accordance with the arrangement of the third embodiment, the room temperature detector 33 detects the room temperature during the defrosting operation. When the room temperature is not higher then the predetermined value (e.g. 5° C.), the solenoid valve 32 in the sixth bypass circuit 31 is opened after the predetermined time interval as stated in reference to the second embodiment, making the sixth bypass circuit 31 to conduct. In this way, the refrigerant which has accumulated in the indoor heat exchanger 6 can be returned to the accumulator 7.

Figure 4:
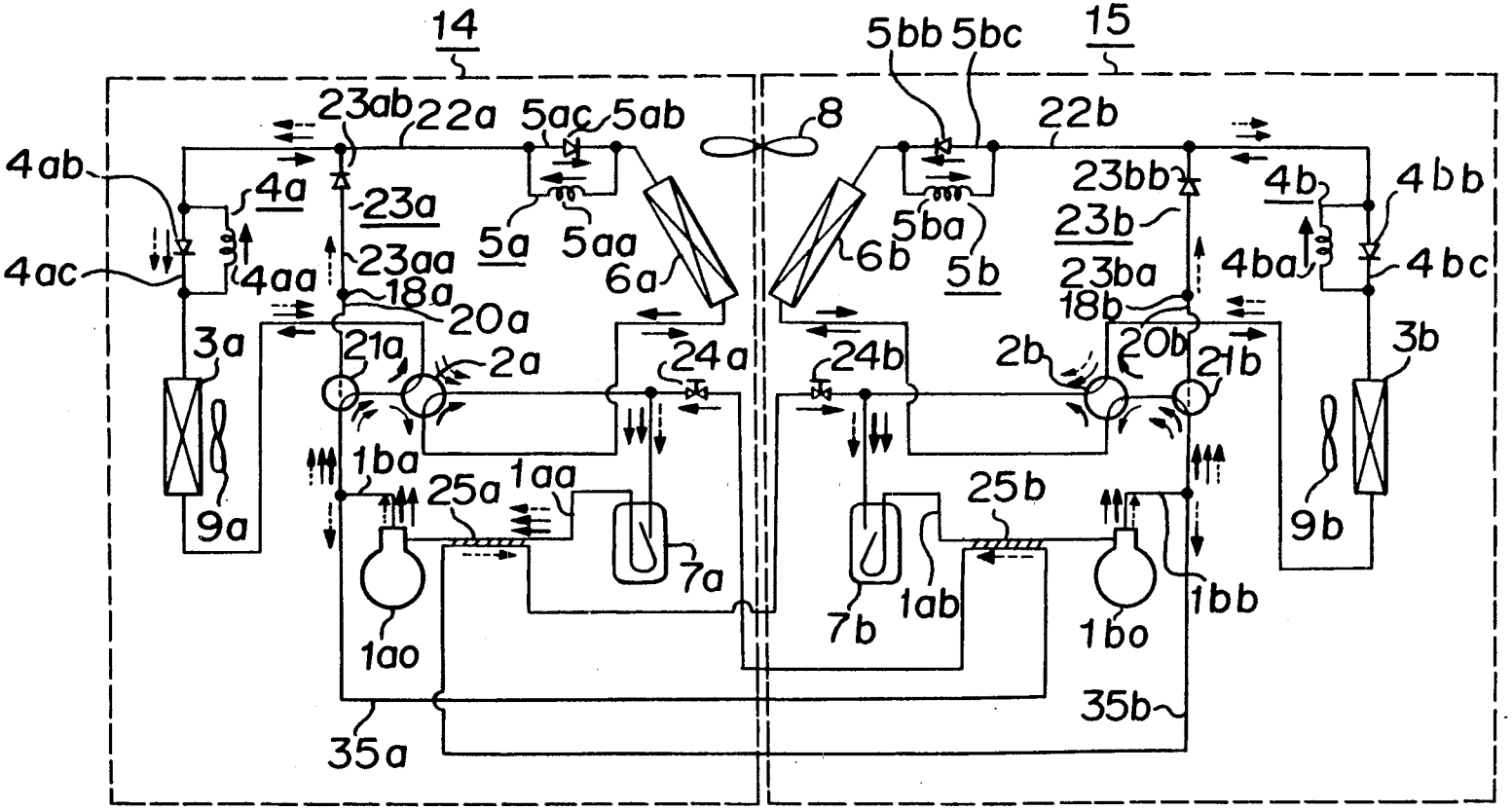
FIGS. 4 through 8 are schematic diagrams showing the refrigeration circuits of other embodiments which have two refrigeration cycle circuits.

Referring now to FIG. 4, there is shown a fourth embodiment of the air conditioning system according to the present invention. In the fourth embodiment, the present invention is applied to an air conditioning system wherein a first refrigeration cycle circuit and a second refrigeration cycle circuit are independently arranged, and indoor heat exchangers in both refrigeration cycle circuits are fed air by a common fan.

In FIG. 4, reference numerals 4*a* and 5*a* designate a first throttle device and a second throttle device, respectively, which function as expansion devices on cooling and on heating, respectively. Reference numeral 4*aa* designates a first decompression device (e.g. capillary tube) which constitutes the first throttle device. Reference numeral 4*ac* designates a first bypass circuit which has a first check valve 4*ab* to be capable of passing the refrigerant in the direction toward an outdoor heat exchanger 3*a*, thereby bypassing the first decompression device 4*aa*. Reference numeral 5*aa* designates a second decompression device (e.g. a capillary tube) which constitutes second throttle device 5*a*. Reference numeral 5*ac* designates a second bypass circuit which has a second check valve 5*ab* to be capable of passing the refrigerant in the direction toward an indoor heat exchanger 6*a*, thereby bypassing the second decompression device 5*aa*. Reference numeral 14 designates a first refrigeration cycle circuit which is constituted by connecting a compressor 1*a*0, a four port reversing valve 2*a*, the outdoor heat exchanger 3*a*, the first throttle device 4*a*, the second throttle device 5*a*, the indoor heat exchanger 6*a* and an accumulator 7*a* in series by means of refrigerant pipes.

On the other hand, reference numerals 4*b* and 5*b* designate a first throttle device and a second throttle device, respectively, which function as expansion devices on cooling and on heating, respectively. Reference numeral 4*ba* designates a first decompression device (e.g. capillary tube) which constitutes the first throttle device 4*b*. Reference numeral 4*bc* designates a first bypass circuit which has a first check valve 4*bb* to be capable of passing the refrigerant in the direction toward an outdoor heat exchanger 3*b*, thereby bypassing the first decompression device 4*ba*. Reference numeral 5*ba* designates a second decompression device (e.g. capillary tube) which constitutes the second throttle device 5*b*. Reference numeral 5*bc* designates a second bypass circuit which has a second check valve 5*bb* to be capable of passing the refrigerant in the direction toward an indoor heat exchanger 6*b*, thereby bypassing the second decompression device 5*ba*. Reference numeral 15 designates a second refrigeration cycle circuit which is constituted by connecting a compressor 1*b*0, the outdoor heat exchanger 3*b*, the first throttle device 4*b*, the indoor heat exchanger 6*b*, and an accumulator 7*b* in series by use of refrigerant pipes.

In the first refrigeration cycle circuit 14, reference numeral 23*a* designates a third bypass circuit which is constituted by a pipe 23*aa* and a check valve 23*ab* connected in series with the pipe 23*aa*, the pipe 23*aa* being smaller than a discharge pipe 1*ba* of the compressor 1*a*0 in inside diameter. The third bypass circuit has one end connected to the discharge pipe 1*ba* of the compressor 1*a*0 through a pipe joint 18*a*, a refrigerant pipe 20*a* having the same inside diameter as the discharge pipe 1*ba*, and a three port switching valve 21*a*. The third bypass circuit has the other end connected to a refrigerant pipe 22*a* which connects between the first and second throttle devices 4*a* and 5*a*. Reference numeral 35*a* designates a fourth bypass circuit in the first refrigeration cycle circuit. Part of the refrigerant which is discharged from the compressor 1*a*0 in the first refrigeration cycle circuit 14 is bypassed to the intake side of the compressor 1*a*0 through an on-off valve 24*a* by the fourth bypass circuit. The fourth bypass circuit 35*a* has a heat exchange portion 25*b* in it, which carries out heat exchange with a refrigerant intake pipe 1*ab* of the compressor 1*b*0 in the second refrigeration cycle circuit 15.

Reference numeral 35*b* designates a fifth bypass circuit in the second refrigeration cycle circuit 15. Part of the refrigerant which is discharged from the compressor 1*b*0 in the second refrigeration cycle circuit 15 is bypassed to the intake side of the compressor 1*b*0 through an on-off valve 24*b* by the fifth bypass circuit 35*b*. The bypass circuit 35*b* has a heat exchange portion 25*a* in it, which carries out heat exchange with a refrigerant intake pipe 1*aa* of the compressor 1*a*0 in the first refrigeration cycle circuit 14.

Firstly, the operation of the first refrigeration cycle circuit 14 in the air conditioning system as constructed above will be explained. On cooling (the flow of the refrigerant is indicated by arrows of thick solid line in FIG. 4), the refrigerant which has been discharged from the compressor 1*a*0 and has become a gas having high temperature and high pressure passes through the three port switching valve 21*a* and the four port reversing valve 2*a*. In the outdoor heat exchanger 3*a*, the gaseous refrigerant carries out heat exchange with the outdoor air which is fed by an outdoor fan 9*a*, thereby being condensed and liquefied. The refrigerant thus liquefied is depressurized by the first decompression device 4*aa* in the first throttle device 4*a* to become a liquid having low temperature and low pressure. The liquid refrigerant passes through the second bypass circuit 5*ac* in the second throttle device 5*a*, and enters the indoor heat exchanger 6*a* where the liquid refrigerant carries out heat exchange with the indoor air fed by a indoor fan 8. As a result, the liquid refrigerant cools the indoor air and is evaporated. The refrigerant thus evaporated returns to the compressor 1*a*0 through the four port reversing valve 2*a* and the accumulator 7*a*. The refrigeration cycle circuit on cooling is formed in that manner.

On heating (the flow of the refrigerant is indicated by arrows of thin solid line in FIG. 4), the refrigerant which has been discharged from the compressor 1*a*0 and has become a gas having high temperature and high pressure passes through the three port switching valve 21*a*. The gaseous refrigerant enters the indoor heat exchanger 6*a* through the four port reversing valve 2*a* which has been switched to heating mode. In the indoor heat exchanger, the gaseous refrigerant carries out heat exchange with the indoor air fed by the indoor fan 8 to heat the indoor air, thereby being condensed and liquefied. The refrigerant thus liquefied is depressurized by the second decompression device 5aa in the second throttle device 5a to become a liquid having low temperature and low pressure. The liquid refrigerant passes through the first bypass circuit 4ac in the first throttle device 4a, and enters the outdoor heat exchanger 3a where the liquid refrigerant carries out heat exchange with the outdoor air fed by the outdoor fan 9a. As a result, the liquid refrigerant absorb heat from the outdoor air to cool it, thereby being evaporated. The refrigerant thus evaporated returns to the compressor 1a0 through the four port reversing valve 2a and the accumulator 7a. The refrigeration cycle circuit on heating is formed in that manner.

On the defrosting operation (the flow of the refrigerant is indicated by arrows of dotted line in FIG. 4) which is required when frost has deposited on the outdoor heat exchanger 3a due to a decrease in the temperature of the outdoor air under the heating operation, the three port switching valve 21a is switched to the third bypass circuit 23a while the four port reversing valve 2a is keeping the heat operation mode. The gaseous refrigerant which has been discharged from the compressor 1a0 passes through the three port switching valve 21a, enters the pipe 23aa of the third bypass circuit 23a connecting to the refrigerant pipe 22a between the first and the second throttle devices 4a and 5a, and enters the refrigerant pipe 22a through the check valve 23ab. Then, the refrigerant passes through the first bypass circuit 4ac in the first throttle device 4a, and enters the outdoor heat exchanger 3a. At that time, the outdoor fan 9a is standstill. The gaseous refrigerant having high temperature melts the frost which has deposited on the outer surface of the outdoor heat exchanger 3a. As a result, the gaseous refrigerant is condensed and liquefied. The refrigerant thus liquefied passes through the four port reversing valve 2a and the accumulator 7a, and returns to the compressor 1a0 through the heat exchange portion 25a. Because the on-off valve 24b in the fifth bypass circuit 35b of the second refrigeration cycle circuit 15 is opened at the time of the defrosting operation in the first refrigeration circuit 14, the refrigerant which has been discharged from the compressor 1b0 in the second refrigeration cycle circuit 15 and has high temperature and high pressure carries out heat exchange with the refrigerant intake pipe 1aa of the first refrigeration cycle circuit 14 at the heat exchange portion 25a.

As explained, the defrosting operation is performed without switching the four port reversing valve 2a from the heating mode to cooling mode, thereby eliminating heat loss due to the switching. In addition, the liquid refrigerant which has low temperature does not pass through the indoor heat exchanger 6a, avoiding the problem wherein cooled air is blown off indoors like the conventional air conditioning systems. Further, the heating operation is enabled by use of the refrigerant circuit which is not carrying out defrosting, thereby preventing the heating operation from being interrupted, and improving comfort indoors.

The arrangement wherein the pipe 23aa forming a part of the third bypass circuit 23a is smaller than the discharge pipe 1ba in inside diameter causes pressure loss to increase the pressure at the high pressure side of the compressor 1a0. This allows the input to the compressor 1a0 to rise, thereby increasing the capacity of the compressor 1a0, and shortening the defrosting time.

In addition, during the defrosting operation for the first refrigeration cycle circuit 14, the on-off valve 24b in the fifth bypass circuit 35b which diverges from the discharge pipe 1bb of the compressor 1b0 in the second refrigeration cycle circuit 15 can be opened to provide the heat exchange portion 25a with the refrigerant having the high pressure and high temperature. As a result, the liquid refrigerant which is about to be inspired to be compressor 1a0 and has low temperature and low pressure can sufficiently absorb heat to be evaporated, thereby preventing the refrigerant from returning to the compressor 1a0 in the form of a liquid. In addition, the pressure at the low pressure side of the compressor 1a0 rises to increase the capacity of the compressor 1a0, thereby offering an advantage in that the defrosting time can be further shortened.

Although the operations of only the first refrigeration cycle circuit 14 on cooling, heating and defrosting have been explained, the second refrigeration cycle circuit 15 carries out the cooling operation, the heating operation and the defrosting operation like the first refrigeration cycle circuit 14. Explanation on the operations of the second refrigeration cycle circuit 15 will be omitted for the sake of clarity.

Figure 5:
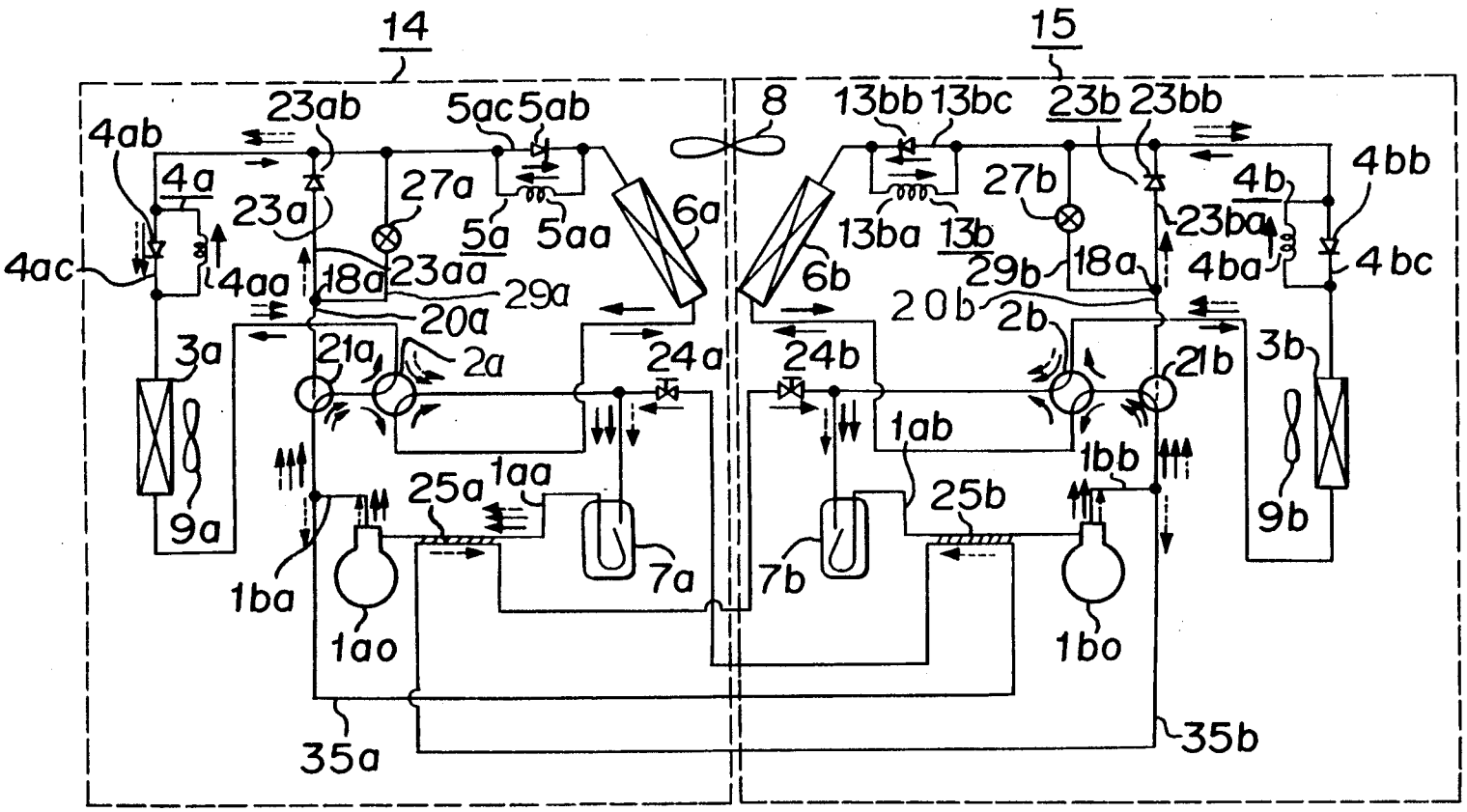

Referring now to FIG. 5, there is shown a fifth embodiment of the air conditioning system according to the present invention. The fifth embodiment is different from the fourth embodiment of the FIG. 4 in that a pressure regulating valve 27a which opens when the pressure at the high pressure side of the compressor 1a0 in the first cycle circuit 14 is not lower than a predetermined level is arranged to be in parallel with the third bypass circuit 23a, that a pressure regulating valve 27b which opens when the pressure at the high pressure side of the compressor 1b0 in the second refrigeration cycle circuit 15 is not lower than a predetermined level is arranged to be in parallel with the second bypass circuit 23b in the second refrigeration cycle circuit 15, and that on defrosting, the pressure at the high pressure side of the compressor under the defrosting operation can be kept not higher than the predetermined level. As a result, the defrosting operation can be free from abnormal stoppage due to high pressure cut which can be caused by an abrupt increase in the pressure at the high pressure side of the third bypass circuit 23a just before completion of defrosting, thereby preventing the defrosting operation from terminating before the temperature at the outlet of the outdoor heat exchanger has reached the temperature for completion of the defrosting operation.

Although in the fifth embodiment the pressure regulating valves are arranged to be in parallel with the third bypass circuits wherein the check valves is connected in series with the pipes having a smaller inside diameter than the discharge pipes of the compressors, the pressure regulating valve in at least one of the refrigeration cycle circuits can be arranged to be in parallel with only a pipe which is smaller than the discharged pipe in inside diameter. In addition, the third bypass circuit in at least one of the refrigerant cycle circuits can be constituted by only a pipe which is smaller than the discharge pipe in inside diameter, and the pressure regulating valve is arranged to be in parallel with the pipe.

Figure 6:
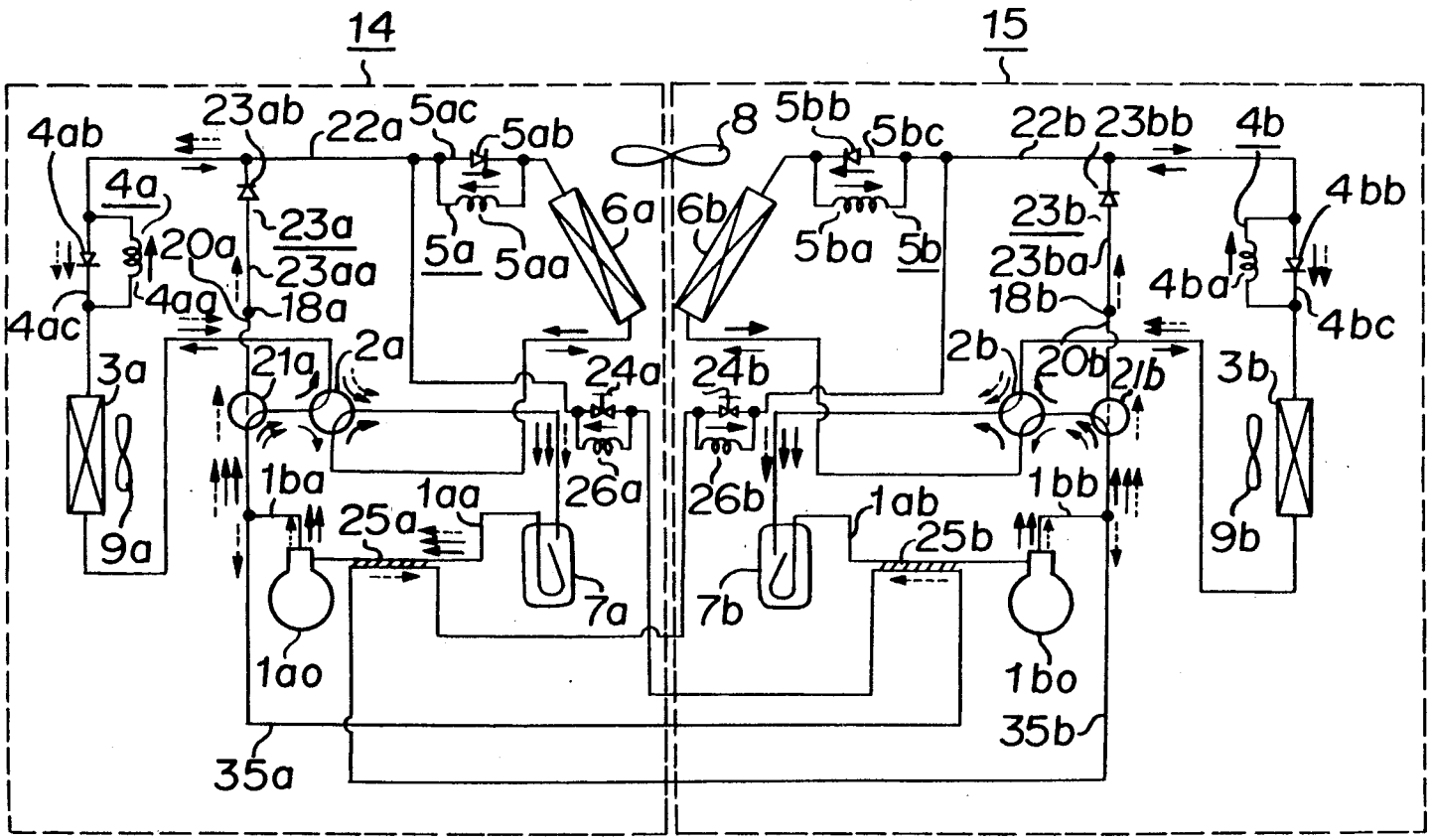

Referring now to FIG. 6, there is shown a sixth embodiment of the air conditioning system according to the present invention. In FIG. 6, parts which are identical or corresponding to those of the system of FIG. 4 are indicated by the same reference numerals, and explanation of these parts will be omitted for the sake of clarity. Reference numerals 4a and 5a designate a first throttle device and a second throttle device, respectively, which function as expansion devices on cooling and on heating, respectively. Reference numeral 4aa designates a first decompression device (e.g. capillary tube) which constitutes the first throttle device. Reference numeral 4ac designates a first bypass circuit which has a check valve 4ab, allowing the refrigerant to bypass the first decompression device 4aa and to pass in the direction toward an outdoor heat exchanger 3a. Reference numeral 5aa designates a second decompression device (e.g. capillary tube) which constitutes the second throttle device 5a. Reference numeral 5ac designates a second bypass circuit which has a check valve 5ab, allowing the refrigerant to bypass the second decompression device 5aa and to pass in the direction toward an indoor heat exchanger 6a. Reference numeral 14 designates a first refrigeration cycle circuit which is constituted by connecting a compressor 1a0, a four port reversing valve 2a, the outdoor heat exchanger 3a, the first throttle device 4a, the second throttle device 5a, the indoor heat exchanger 6a and an accumulator 7a in series by use of refrigerant pipes.

Reference numerals 4b and 5b designate a first throttle device and a second throttle device, respectively, which function as expansion devices on cooling and on heating, respectively. Reference numeral 4ba designates a first decompression device (e.g. capillary tube) which constitutes the first throttle device 4b. Reference numeral 4bc designates a first bypass circuit which has a check valve 4bb, allowing the refrigerant to bypass the first decompression device 4ba and to pass in the direction toward an outdoor heat exchanger 3b. Reference numeral 5ba designates a second decompression device (e.g. capillary tube) which constitutes the second throttle device 5b. Reference numeral 5bc designates a second bypass circuit which has a check valve 5bb, allowing the refrigerant to bypass the second decompression device 5ba and to pass in the direction toward an indoor heat exchanger 6b. Reference numeral 15 designates a second refrigeration cycle circuit which is constituted by connecting a compressor 1b0, the outdoor heat exchanger 3b, the first throttle device 4b, the second throttle device 5b, the indoor heat exchanger 6b and an accumulator 7b in series by use of refrigerant pipes.

In the first refrigeration cycle circuit 14, reference numeral 23a designates a third bypass circuit which is constituted by a pipe 23aa having a smaller inside diameter than a discharge pipe 1ba of the compressor 1a0, and a check valve 23ab connected in series with the pipe 23aa. The third bypass circuit has one end connected to the discharge pipe 1ba through a pipe joint 18a, a refrigerant pipe 20a having the same inside diameter as the discharge pipe 1ba of the compressor 1a0 and a three port switching valve 21a. The third bypass circuit has the other end connected to a refrigerant pipe 22a between the first and second throttle devices 4a and 5a. Reference numeral 35a designates a fourth bypass circuit in the first refrigeration cycle circuit 14, which directs part of the refrigerant discharged from the compressor 1a0 in the first refrigeration cycle circuit 14 to the refrigerant pipe 22a between the first and second throttle devices 4a and 5a in the first refrigeration cycle circuit 14 through a decompression device (e.g. capillary tube) 26a and an on-off valve (e.g. solenoid on-off valve) 24a for bypassing the decompression device 26a, and which carries out heat exchange, at a heat exchange portion 25b, with a refrigerant intake tube 1ab of the compressor 1b0 in the second refrigeration cycle circuit 15.

Reference numeral 35b designates a fifth bypass circuit in the second refrigerant cycle circuit 15, which directs part of the refrigerant discharged from the compressor 1b0 in the second refrigeration cycle circuit 15 to a refrigerant pipe 22b between the first and second throttle devices 4b and 5b in the second refrigeration cycle circuit 15 through a decompression device (e.g. capillary tube) 26b and an on-off valve (e.g. solenoid on-off valve) 24b for bypassing the decompression device 26b, and which carries out heat exchange, at a heat exchange portion 25a, with a refrigerant intake pipe 1aa of the compressor 1a0 in the first refrigeration cycle circuit 14.

With regard to the air conditioning system of the sixth embodiment, firstly, the operation of the first refrigeration cycle circuit 14 will be explained. On cooling (the flow of the refrigerant is indicated by arrows of thick solid line in FIG. 6), the refrigerant which has been discharge from the compressor 1a0 and has become a gas having high temperature and high pressure passes through the three port switching valve 21a and the four port reversing valve 2a. In the outdoor heat exchanger 3a, the gaseous refrigerant carries out heat exchange with the outdoor air fed by an outdoor fan 9a, thereby being condensed and liquefied. The refrigerant thus liquefied is depressurized by the first decompression device 4aa in the first throttle device 4a, becoming a liquid having low temperature and low pressure. On the other hand, part of the gaseous refrigerant which has been discharged from the compressor 1a0 is introduced into the fourth bypass circuit 35a. That part of the refrigerant carries out heat exchange, at the heat exchange portion 25b in the second refrigeration cycle circuit 15, with the refrigerant which is about to be inspired into the compressor 1b0 in the second refrigeration cycle circuit 15. At the heat exchange portion 25b, that part of the gaseous refrigerant heats the inspired refrigerant to make it completely evaporate, and the gaseous refrigerant itself is condensed and liquefied. The refrigerant thus liquefied is depressurized by the decompression device 26a to become a liquid having low temperature and low pressure. The liquid refrigerant joins in the refrigerant pipe 22a between the first and second throttle devices 4a and 5a, and passes through the first bypass circuit 5ac in the second throttle device 5a. Then, the refrigerant enters the indoor heat exchanger 6a where it carries out heat exchange with the indoor air fed by a common indoor fan 8. In this way, the refrigerant cools the indoor air, thereby becoming evaporated. The refrigerant thus evaporated returns to the compressor 1a0 through the four port reversing valve 2a and the accumulator 7a. The refrigeration cycle circuit on cooling is formed in that manner.

On heating (the flow of the refrigerant is indicated by arrows of thin solid line in FIG. 6), the refrigerating which has been discharged from the compressor 1a0 and has become a gas having high temperature and high pressure passes through the three port switching valve 21a, and the four port reversing valve 2a which has been switched to heating mode. Then, the gaseous refrigerant enters the indoor heat exchanger 6a where it carries out heat exchange with the indoor air fed by the indoor fan 8. The refrigerant heats the indoor air, becoming condensed and liquefied. The refrigerant thus liquefied is depressurized by the second decompression device 5aa in the second throttle device 5a, becoming a liquid having low temperature and low pressure. On the other hand, part of the gaseous refrigerant which has been discharged from the compressor 1a0 is introduced into the fourth bypass circuit 35a. That part of the refrigerant carries out heat exchange, at the heat exchange portion 25b in the second refrigeration cycle circuit 15, with the refrigerant which is about to be inspired into the compressor 1b0 in the second refrigeration cycle circuit 15 and has low pressure. That part of the gaseous refrigerant heats the inspired refrigerant to make it completely evaporate. That part of the refrigerant itself is condensed and liquefied. The refrigerant thus liquefied is depressurized by the decompression device 26a to become a liquid having low temperature and low pressure. Then, the liquid refrigerant joins into the refrigerant pipe 22a between the first and second throttle devices 4a and 5a. Then, the refrigerant passes through the first bypass circuit 4ac in the first throttle device 4a, and enters the outdoor heat exchanger 3a where it carries out heat exchange with the outdoor air fed by the outdoor fan 9a. The liquid refrigerant absorbs heat from the outdoor air to cool it, thereby being evaporated. The refrigerant thus evaporated returns to the compressor 1a0 through the four port reversing valve 2a and the accumulator 4a. The refrigeration cycle circuit on heating is formed in that manner.

At the time of the defrosting operation (the flow of the refrigerant is indicated by arrows of dotted line) which is required when frost has deposited on the outdoor heat exchanger 3a during the heating operation due to, e.g. a decrease in the outdoor air temperature, the three port switching valve 21a is switched to the third bypass circuit 23a while the four port reversing valve 2a is keeping the heating mode. The gaseous refrigerant which has been discharged from the compressor 1a0 passes through the three port switching valve 21a, and flows into the refrigerant pipe 22a through the pipe 23aa of the third bypass circuit 23a connected to the refrigerant pipe 22a between the first and second throttle devices 4a and 5a, and through the check valve 23ab. Then, the gaseous refrigerant passes through the first bypass circuit 4ac in the first throttle device, and enters the outdoor heat exchanger 3a. At that time, the outdoor fan 9a is standstill. The gaseous refrigerant having high temperature carries out heat exchange with the frost which has deposited on the outer surface of the outdoor heat exchanger 3a, and melts the frost. As a result, the gaseous refrigerant is condensed and liquefied. The refrigerant thus liquefied passes through the four port reversing valve 2a, and returns to the compressor 1a0 through the accumulator 7a and the heat exchanger portion 25a. On defrosting, the on-off valve 24b in the fifth bypass circuit 35b of the second refrigeration cycle circuit 15 is opened so that the refrigerant intake pipe 1aa of the first refrigeration cycle circuit 14 on defrosting carries out heat exchange, at the heat exchange portion 25a, with the refrigerant which has been discharged from the compressor 1b0 of the second refrigeration cycle circuit 15 and has high temperature and high pressure.

This arrangement allows the defrosting operation to be carried out without switching the four port reversing valve 2a from the heating mode to the cooling mode, thereby preventing heat loss from causing due to the switching. In addition, the liquid refrigerant having low temperature does not pass through the indoor heat exchanger 6a, thereby avoiding the problem wherein cooled air is blown off indoors like the conventional air conditioning systems. The heating operation can be performed by only the refrigerant circuit which is not on defrosting, thereby preventing the heating operation from being stopped due to the defrosting operation, and improving comfort indoors.

During the normal cooling and heating operations, the intake pipes 1aa and 1ab to the compressors 1a0 and 1ab0 are heat exchanged by the gaseous refrigerants which have been discharged from the respective compressors 1a0 and 1b0 and have high temperature and high pressure, thereby preventing the refrigerant from returning to the compressors 1a0 and 1b0 in the form of a liquid in order to be free from the liquid compression in the compressors.

In addition, the arrangement wherein the pipe 23aa constituting a part of the fourth bypass circuit 23a is smaller than the discharge pipe 1ba in inside diameter causes pressure loss to increase the pressure at the high pressure side of the compressor 1a0. This allows the input to the compressor to rise, thereby increasing the capacity of the compressor 1a0, and shortening the defrosting time.

Further, during the defrosting operation, the on-off valve 24b in the fifth bypass circuit 35b which diverges from the discharge pipe 1bb of the compressor 1b0 in the second refrigeration circuit 15 is opened to provide the heat exchange portion 25a with the refrigerant having high pressure and high temperature. As a result, the liquid refrigerant which is about to inspired to the compressor 1a0 and has low temperature and low pressure can sufficiently absorb heat to be evaporated, thereby being prevented from returning to the compressor 1a0 in the form of a liquid. In addition, the pressure at the low pressure side of the compressor 1a0 is raised to increase the capacity of the compressor 1a0, thereby offering an advantage in that the defrosting time can be further shortened.

Although explanation of the operation of only the first refrigeration cycle circuit 14 has been made, the second refrigeration cycle circuit 15 can carry out the cooling operation, the heating operation and the defrosting operation like the first refrigeration cycle circuit 14. Explanation on the operation of the second refrigeration cycle circuit will be omitted for the sake of clarity.

Figure 7:
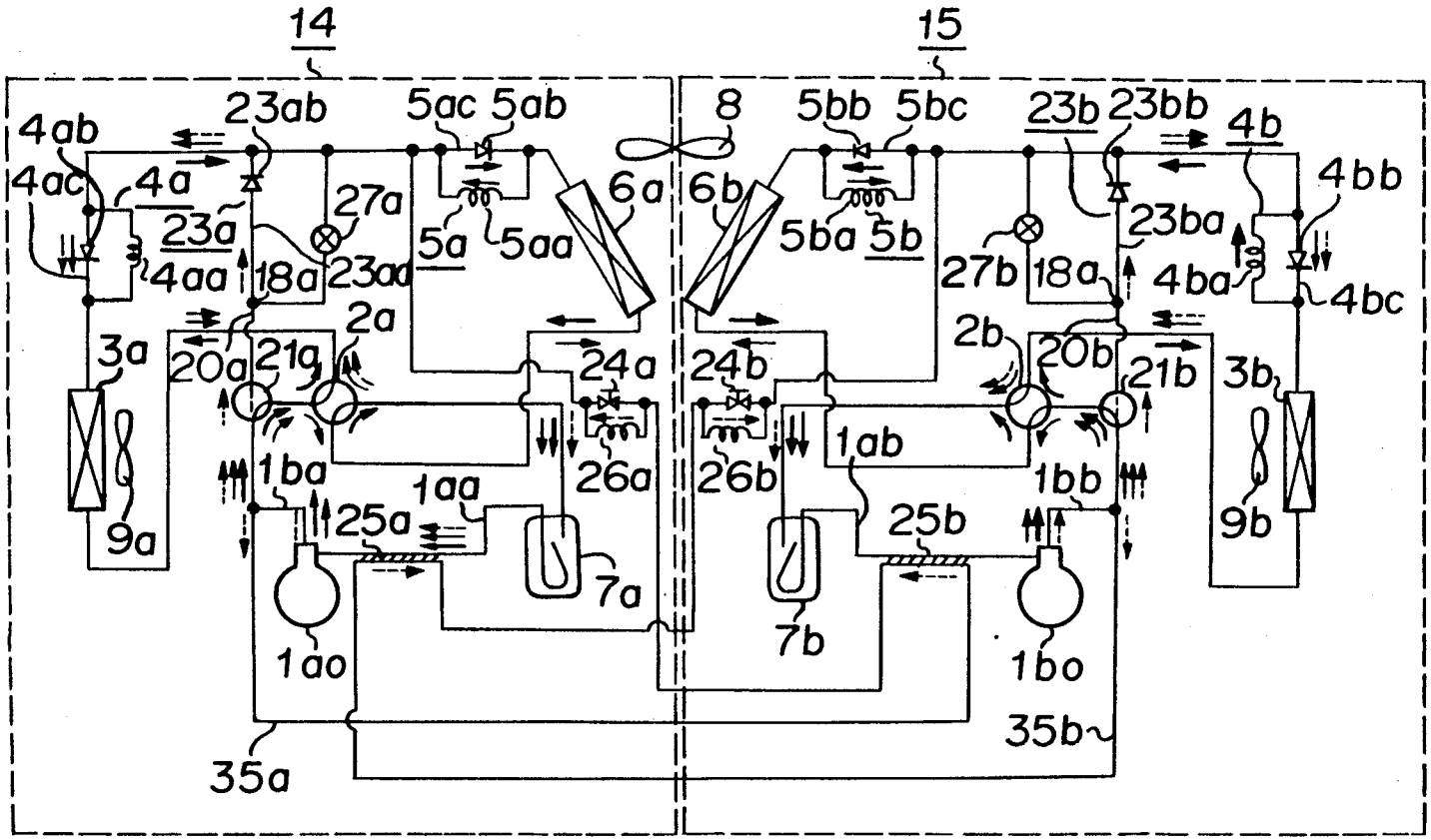

Referring now to FIG. 7, there is shown a seventh embodiment of the air conditioning system according to the present invention. The seventh embodiment is different from the sixth embodiment of FIG. 6 in that a pressure regulating valve 27a which opens when the pressure at the high pressure side of the compressor 1a0 in the first refrigeration cycle circuit 14 is not lower than a predetermined level is arranged to be in parallel with the third bypass circuit 23a, that a pressure regulating valve 27b which opens when the pressure at the high pressure side of the compressor 1b0 in the second refrigeration cycle circuit 15 is not lower than a predetermined level is arranged to be in parallel with the third bypass circuit 23b in the second refrigeration cycle circuit 15, and that during the defrosting operation, the pressure at the high pressure side of the compressor on defrosting can be kept at a predetermined level or less. As a result, the system can be free from abnormal stoppage due to high pressure cut which can be caused because of an abrupt increase in the pressure at the high pressure side of the third bypass circuit just before completion of the defrosting operation. The defrosting operation can be prevented from terminating before the temperature at the outlet of the outdoor heat exchanger has reached the temperature for completion of the defrosting operation.

Although explanation of the seventh embodiment has been made for the case wherein the third bypass circuits are constituted by the check valves, and the pipes connected in series to the check valves and having a smaller inside diameter than the discharge pipes of the compressors, the present invention is not limited to this case. The third bypass circuit in at least one of the refrigeration cycle circuits can be constituted by only a pipe having a smaller inside diameter than the discharge pipe. In addition, the third bypass circuit in at least one of the refrigeration cycle circuits can be constituted by only a pipe having a smaller inside diameter than the discharge pipe, and the pressure regulating valve is arranged to be in parallel with the pipe.

Figure 8:
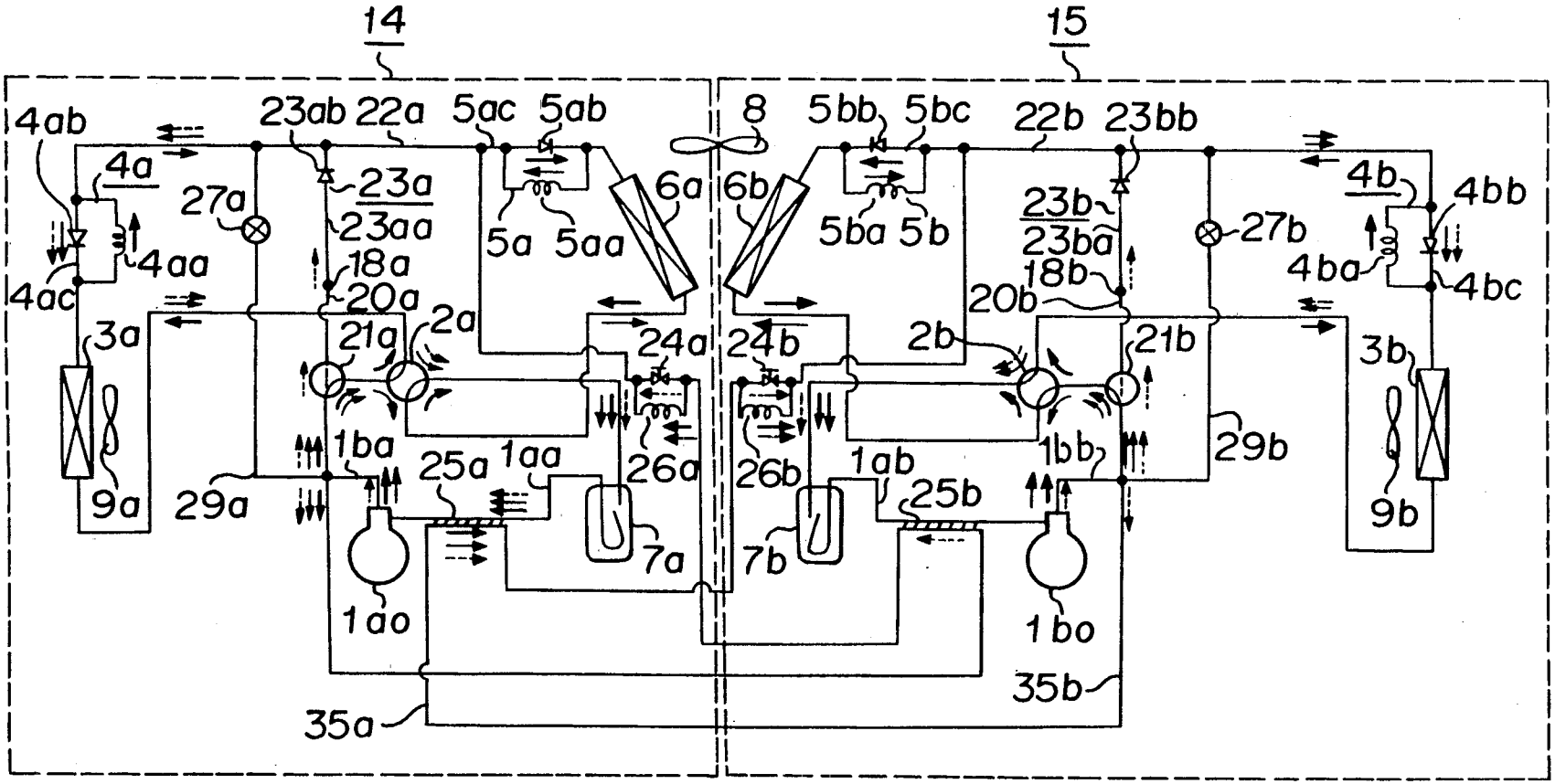

Referring now to FIG. 8, there is shown an eighth embodiment of the air conditioning system according to the present invention. Parts which are identical or corresponding to those of the embodiment shown in FIG. 4 are indicated by the same reference numerals as those of FIG. 4, and explanation of those parts will be omitted for the sake of clarity.

Reference numerals 4*a* and 5*a* indicate a first throttle device and a second throttle device, respectively, which function as expansion devices on cooling and on heating, respectively. Reference numeral 4*aa* designates a first decompression device (e.g. capillary tube) which constitutes the first throttle device. Reference numeral 4*ac* designates a first bypass circuit which has a check valve 4*ab*, allowing the refrigerant to bypass the first decompression device 4*aa* and pass through in the direction toward an outdoor heat exchanger 3*a*. Reference numeral 5*aa* designates a second decompression device (e.g. capillary tube) which constitutes the second throttle device 5*a*. Reference numeral 5*ac* indicates a second bypass circuit which has a check valve 5*ab*, allowing the refrigerant to bypass the second decompression device 5*aa* and to pass in the direction toward an indoor heat exchanger 6*a*. Reference numeral 14 designates a first refrigeration cycle circuit which is constituted by connecting a compressor 1*a*0, a four port reversing valve 2*a*, the outdoor heat exchanger 3*a*, the first throttle device 4*a*, the second throttle device 5*a*, the indoor heat exchanger 6*a* and accumulator 7*a* in series by use of refrigerant pipes. In the first refrigeration cycle circuit 14, reference numeral 23*a* designates a fourth bypass circuit which is constituted by a pipe 23*aa* having a smaller inside diameter than a discharge pipe 1*ba* of the compressor 1*a*0, and a check valve 23*ab* connected in series to the pipe 23*aa*. The fourth bypass circuit has one end connected to the discharge pipe 1*ba* through pipe joint 18*a*, a refrigerant pipe 20*a* having the same inside diameter as the discharge pipe 1*ba* of the compressor 1*a*0, and a three port switching valve 21*a*. The fourth bypass circuit has the other end connected to a refrigeration pipe 22*a* between the first and second throttle devices 4*a* and 5*a*. Reference numeral 35*a* indicates a fourth bypass circuit in the first refrigeration cycle circuit 14, which directs part of the refrigerant discharged from the compressor 1*a*0 to the refrigerant pipe 22*a* between the first and second throttle devices 4*a* and 5*a* through a compression device (e.g. capillary tube) 26*a* and an on-off valve (e.g. solenoid on-off valve) 24*a* for bypassing the decompression device 26*a*, and which carries out heat exchange, at heat exchange portion 25*b* on the way, with a refrigerant intake pipe lab of a compressor 1*b*0 in a second refrigeration cycle circuit 15. Reference numeral 29*a* designates a fifth bypass circuit which has a pressure regulating valve 27*a*, which has one end connected to the discharge pipe 1*ba* which connects the three port switching valve 21*a* to the compressor 1*a*0, and which has the other end connected to the refrigerant pipe 22*a* between the first and second throttle devices 4*a* and 5*a*. Reference numerals 4*b* and 5*b* designate a first throttle device and a second throttle device, respectively, which function as expansion devices on cooling and on heating, respectively. Reference numeral 4*ba* designates a first decompression device (e.g. capillary tube) which constitutes the first throttle device 4*b*. Reference numeral 4*bc* designates a first bypass circuit which has a check valve 4*bb*, allowing the refrigerant to bypass the first decompression device 4*ba* and to pass in the direction toward an outdoor heat exchanger 3*b*. Reference numeral 5*ba* designates a second decompression device (e.g. capillary tube) which constitutes the second throttle device 5*b*. Reference numeral 5*bc* designates a second bypass circuit which has a check valve 5*bb*, allowing the refrigerant to bypass the second decompression device 5*ba* and pass in the direction toward an indoor heat exchanger 6*b*. Reference numeral 15 indicates the second refrigeration cycle circuit which is constituted by connecting the compressor 1*b*0, the outdoor heat exchanger 3*b*, the first throttle device 4*b*, the second throttle device 5*b*, the indoor heat exchanger 6*b* and an accumulator 7*b* in series by use of refrigerant pipes. In the second refrigeration cycle circuit 15, reference numeral 23*b* indicates a third bypass circuit which is constituted by a pipe 23*ba* having a smaller inside diameter than a discharge pipe 1*bb* of the compressor 1*b*0, and a check valve 23*bb* connected in series to the pipe 23*ba*. The third bypass circuit has one end connected to the discharge pipe 1*bb* through a pipe joint 18*b*, a refrigerant pipe 20*b* having the same inside diameter as the discharge pipe 1*bb* of the compressor 1*b*0, and a three port switching valve 21*b*. The third bypass circuit 23*b* has the other end connected to a refrigerant pipe 22*b* between the first and second throttle devices 4*b* and 5*b*. Reference numeral 35*b* indicates a fourth bypass circuit in the second refrigeration cycle circuit, which directs part of the refrigerant discharged from the compressor 1*b*0 in the second refrigeration cycle circuit 15 to the refrigerant pipe 22*b* between the first and second throttle devices 4*b* and 5*b* through a decompression device (e.g. capillary tube) 26*b* and an on-off valve (e.g. solenoid on-off valve) 24*b* for bypassing the decompression device 26*b*, and which carries out heat exchange, at a heat exchange portion 25*a* on the way, with a refrigerant intake pipe 1*aa* of the compressor 1*a*0 of the first refrigeration cycle circuit 14. Reference numeral 29*b* designates a sixth bypass circuit which has a pressure regulating valve 27*b*. The sixth bypass circuit 29*b* has one end connected to the discharge pipe 1*bb* which connects the three port switching valve 21*b* to the compressor 1*b*0. The sixth bypass circuit 29*b* has the other end connected to the refrigerant pipe 22*b* between the first and second throttle devices 4*b* and 5*b*.

With regard to the air conditioning system of the eighth embodiment, firstly, the operation of the first refrigeration cycle circuit 14 will be explained. On cooling (the flow of the refrigerant is indicated by arrows of thick solid line in FIG. 8), the refrigerant which has been discharged from the 1a0 and has become a gas having high temperature and high pressure passes through the three port switching valve 21a and the four port reversing valve 2a. In the outdoor heat exchanger 3a, the gaseous refrigerant carries out heat exchange with the outdoor air fed by an outdoor fan 9a, thereby being condensed and liquefied. The refrigerant thus liquefied is depressurized by the first decompression device 4aa in the first throttle device 4a to become a liquid having low temperature and low pressure. On the other hand, part of the gaseous refrigerant which has been discharged from the compressor 1a0 is introduced into the fourth bypass circuit 35a. That part of the gaseous refrigerant carries out heat exchange, at the heat exchange portion 25b in the second refrigeration cycle circuit 15, with the refrigerant which is about to be inspired into the compressor 1b0 in the second refrigeration cycle circuit 15 and has low temperature. As a result, that part of the gaseous refrigerant heats the inspired refrigerant to make it completely evaporate, and that part of gaseous refrigerant itself is condensed and liquefied. The refrigerant thus liquefied is depressurized by the decompression device 26a to become a liquid having low temperature and low pressure. The refrigerant thus liquefied joins in the refrigerant pipe 22a between the first and second throttle devices 4a and 5a, and passes through the second bypass circuit 5ac in the second throttle device 5a. The refrigerant enters the indoor heat exchanger 6a where it carries out heat exchange with the indoor air fed by a common indoor fan 8. As a result, the liquid refrigerant cools the indoor air, thereby being evaporated. The refrigerant thus evaporated returns to the compressor 1a0 through the four port reversing valve 2a and the accumulator 7a. The refrigeration cycle circuit on cooling is formed in that manner. If the pressure at the high pressure side of the compressor 1a0 is not lower than a predetermined level for any reason, the pressure regulation valve 27a is activated to maintain the pressure at the high pressure side of the compressor 1a0 at the predetermined level.

On heating (the flow of the refrigerant is indicated by arrows of thin solid line in FIG. 8), the refrigerant which has been discharged for the compressor 1a0 and has become a gas having high temperature and high pressure passes through the three port switching valve 21a, and through the four port reversing valve 2a which has been switched to heating mode. The gaseous refrigerant enters the indoor heat exchanger 6a where it carries out with the indoor air fed by the indoor fan 8. As a result, the gaseous refrigerant heats the indoor air, thereby being condensed and liquefied. The refrigerant thus liquefied is depressurized by the second decompression device 5aa in the second throttle device 5a to become a liquid having low temperature and low pressure. On the other hand, part of the gaseous refrigerant which has been discharged from the compressor 1a0 is introduced into the fourth bypass circuit 35a. That part of the gaseous refrigerant carries out heat exchange, at the heat exchange portion 25b in the second refrigeration cycle circuit 15, with the refrigerant which is about to be inspired into the compressor 1b0 in the second refrigeration cycle circuit 15 and has low pressure. As a result, that part of the gaseous refrigerant heats the inspired refrigerant to make it completely evaporate, and that part of the gaseous refrigerant itself is condensed and liquefied. The refrigerant thus liquefied is depressurized by the decompression device 26a to become a liquid having low temperature and low pressure. Then, the liquid refrigerant joins in the refrigerant pipe 22a between the first and second throttle devices 4a and 5a, and passes through the first bypass circuit 4ac in the first throttle device 4a. The refrigerant enters the outdoor heat exchanger 3a where it carries out heat exchange with the outdoor air fed by the outdoor fan 9a. As a result, the refrigerant absorbs heat from the outdoor air to cool it, thereby being evaporated. The refrigerant thus evaporated returns to the compressor 1a0 through the four port reversing valve 2a and the accumulator 7a. The refrigeration cycle circuit on heating is formed in that manner. If the pressure at the high pressure side of the compressor 1a0 is not lower than a predetermined level for any reason, the pressure regulating valve 27a is activated to maintain the pressure at the high pressure side of the compressor 1a0 at the predetermined level.

At the time of the defrosting operation (the flow of the refrigerant is indicated by arrows of dotted line in FIG. 8) which is required when frost has deposited on the outdoor heat exchanger 3a on heating due to, e.g. a decrease in the outdoor air temperature, the three port switching valve 21a is switched to the third bypass circuit 23a while the four port reversing valve 2a is keeping the heating mode. The gaseous refrigerant which has been discharged from the compressor 1a0 passes through the three port switching valve 21a, and flows into the refrigeration pipe 22a through the pipe 23aa of the third bypass circuit 23a connected to the refrigeration pipe 22a between the first and second throttle devices 4a and 5a, and through the check valve 23ab. Then, the refrigerant enters the outdoor heat exchanger 3a through the first bypass circuit 4ac in the first throttle device 4a. At that time, the outdoor fan 9a is standstill. The gaseous refrigerant having high temperature carries out heat exchange with the frost which has deposited on the outer surface of the outdoor heat exchanger 3a, and melts the frost. As a result, the gaseous refrigerant is condensed and liquefied. The refrigerant thus liquefied passes through the four port reversing valve 2a, and returns to the compressor 1a0 through the accumulator 7a and the heat exchange portion 25a. At the time of carrying out the defrosting operation in the first refrigeration cycle circuit 14, the on-off valve 24b in the fifth bypass circuit 35b of the second refrigeration cycle circuit 15 is opened so that the refrigerant which has been discharged from the compressor 1b0 of the second refrigeration cycle circuit 15 carries out heat exchange, at the heat exchange portion 25a, with the refrigerant intake pipe 1aa of the first refrigeration cycle circuit 14. And, if the pressure at the high pressure side of the compressor 1a0 is not lower than a predetermined level, the pressure regulating valve 27a is activated to maintain the pressure at the high pressure side of the compressor 1a0 at the predetermined level or less.

As explained, the defrosting operation can be performed without switching the four port reversing valve 2a from the heating mode to the cooling mode, thereby preventing heat loss from causing due to the switching. In addition, the liquid refrigerant having low temperature does not pass through the indoor heat exchanger 6a, thereby avoiding the problem wherein cooled air is blown off indoors like the conventional air conditioning systems. The heating operation can be performed by only the refrigerant circuit which is not on defrosting, and the heating operation can be continued even on defrosting to improve comfort indoors.

During the normal cooling and heating operation, the heat exchange portions 25*a* and 25*b* allow the intake pipes 1*aa* and 1*ab* to the compressors 1*a*0 and 1*b*0 to carry out heat exchange with the refrigerant which has been discharged from the compressors 1*a*0 and 1*b*0 and has become a gas having high temperature and high pressure, preventing the refrigerant from returning to the compressors 1*a*0 and 1*b*0 in the form of a liquid, and preventing liquid compression from causing in the compressors.

The arrangement wherein the pipe 23*aa* constituting a part of the third bypass circuit 23*a* is smaller than the discharge pipe 1*ba* in inside diameter causes pressure loss to rise the pressure at the high pressure side of the compressor 1*a*0. As a result, the input to the compressor 1*a*0 can be increased to raise the capacity of the compressor 1*a*0, thereby shortening the defrosting time.

On defrosting, the on-off valve 24*b* in the fifth bypass circuit 35*b* which diverges from the discharge pipe 1*bb* of the compressor 1*b*0 in the second refrigeration cycle circuit 15 which is not on defrosting is opened to provide the heat exchange portion 25*a* with the refrigerant having high pressure and high temperature. As a result, the liquid refrigerant which is about to be inspired into the compressor 1*a*0 and has low temperature and low pressure can sufficiently absorb heats to be evaporated, thereby preventing the refrigerant from returning to the compressor 1*a*0 in the form of a liquid. In addition, the pressure at the low pressure side of the compressor 1*a*0 is raised to increase the capacity of the compressor 1*a*0, thereby offering an advantage in that the defrosting time can be further shortened.

When the pressure at the high pressure side of the compressor 1*a*0 is not lower than a predetermined level, the pressure regulating valve 27*a* in the sixth bypass circuit 29*a* is activated to maintain the pressure at the high pressure side of the compressor on defrosting at the predetermined level or less. As a result, the system can be free from abnormal stoppage due to high pressure cut which can be caused by an abrupt increase in the pressure at the high pressure side of the third bypass circuit just before completion of the defrosting operation. In that manner, the defrosting operation can be prevented from terminating before the temperature at the outlet of the outdoor heat exchanger has reached the temperature for completion of the defrosting operation.

In addition, if the pressure at the high pressure side of the compressor 1*a*0 is not lower than a predetermined level for any reason even on cooling or on heating, the pressure regulating valve 27*a* in the sixth bypass circuit 29*a* is activated to maintain the pressure at the high pressure side constant, thereby preventing abnormal stoppage from causing due to high pressure cut.

Although explanation of the operation of only the first refrigeration cycle circuit 14 has been made, the second refrigeration cycle circuit 15 can also carries out cooling, heating and defrosting like the first refrigeration cycle circuit 14. Explanation of the operation of the second refrigeration cycle circuit 15 will be omitted for the sake of clarity.

Although in the eighth embodiment, the third bypass circuit is constituted by the check valve, and the pipe connected in series to the check valve and having a smaller inside diameter than the discharge pipe of the compressor, the present invention is not limited to this case. The third bypass circuit in at least one of the refrigeration cycle circuits can be constituted by only a pipe having a smaller inside diameter than the discharge pipe. In addition, the third bypass circuit can be constituted by only a pipe having a smaller inside diameter than the discharge pipe, and a pressure regulating valve can be arranged to be in parallel with the pipe.

Obviously, numerous modifications and variations of the present invention are possible in light of the above teachings. It is therefore to be understood that within the scope of the appended claims, the invention may be practiced otherwise than as specifically described herein.

What is claimed is:

1. An air conditioning system which can carry out cooling and heating, comprising:

a refrigerant circuit which is constituted by connecting a compressor, a three port switching valve, a four port reversing valve, an outdoor heat exchanger, a first throttle device including a first decompression device, a second throttle device including a second decompression device, an indoor heat exchanger and an accumulator in series by use of refrigerant pipes;

a first bypass circuit which diverges from the pipe connecting between the three port switching valve and the four port reversing valve, which is constructed to carry out heat exchange with the intake pipe connecting between the accumulator and the compressor, and which is connected as a bypass to the pipe connecting between the first and second throttle devices;

a second bypass circuit having a check valve to bypass the first decompression device;

a third bypass circuit having a check valve to bypass the second decompression device;

a fourth bypass circuit which diverges from the discharge pipe through the three port switching valve, which is connected as a bypass to the pipe between the first and second throttle devices, and which is smaller than the discharge pipe in inside diameter; and a fifth bypass circuit which diverges from the pipe connecting between the discharge pipe and the three port switching valve, and which is connected as a bypass to the the pipe between the first and second throttle devices through a pressure regulating valve;

wherein the three port switching valve is switched to open the fourth bypass circuit, thereby carrying out defrosting.

2. An air conditioning system according to claim 1, wherein when the temperature in the room to be air conditioned is not higher than a predetermined level during the defrosting operation, the three port switching valve is returned to heating mode at a predetermined time interval.

3. An air conditioning system according to claim 1, further comprising:

a sixth bypass circuit which diverges from the pipe connecting between the indoor heat exchanger and the second throttle valve, and which is connected as a bypass to the accumulator through an on-off valve;

wherein when the temperature in the room to be air conditioned is not higher than a predetermined level during the defrosting operation, the sixth bypass circuit is opened at a predetermined time interval.

* * * * *